US006464595B2

(12) United States Patent
Tsujita

(10) Patent No.: US 6,464,595 B2
(45) **Date of Patent: *Oct. 15, 2002**

(54) AUTOMATIC BOWLING SCORING APPARATUS AND BOWLING ALLEY MANAGEMENT SYSTEM

(75) Inventor: Masahiro Tsujita, Osaka (JP)

(73) Assignee: Telesystems Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/827,523

(22) Filed: Apr. 6, 2001

(65) Prior Publication Data

US 2001/0021672 A1 Sep. 13, 2001

Related U.S. Application Data

(63) Continuation of application No. 08/837,990, filed on Apr. 15, 1997.

(30) Foreign Application Priority Data

Aug. 23, 1996 (JP) ..... 8-222638

(51) Int. Cl.[7] ..... A63D 5/04
(52) U.S. Cl. ..... 473/70; 463/25
(58) Field of Search ..... 473/54, 64–71; 463/1, 16, 42

(56) References Cited

U.S. PATENT DOCUMENTS

| | | | | |
|---|---|---|---|---|
| 4,140,404 | A | 2/1979 | Kaenel | 400/120 |
| 4,652,998 | A | 3/1987 | Koza et al. | 364/412 |
| 5,241,379 | A | 8/1993 | Tsujita | 358/93 |
| 5,551,692 | A | 9/1996 | Pest et al. | 273/143 R |
| 5,577,971 | A | 11/1996 | Filo | 473/54 |
| 5,626,523 | A | 5/1997 | Mowers et al. | 473/58 |
| 5,709,607 | A | 1/1998 | Mowers et al. | 473/58 |
| 5,816,918 | A | 10/1998 | Kelly et al. | 463/16 |
| 6,048,272 | A | 4/2000 | Tsujita | 473/70 |

*Primary Examiner*—Valencia Martin-Wallace
*Assistant Examiner*—John M Hotaling, II
(74) *Attorney, Agent, or Firm*—Pillsbury Winthrop LLP

(57) ABSTRACT

The invention provides an automatic bowling scoring apparatus, as well as a bowling alley management system, which can make the bowling game itself more exciting besides the pleasure attributable to the competition in the score of the bowling game. The score of the bowling game is counted by detecting a pin state after a bowl of a ball in a lane. A service medium carrying information on service to be offered to customers in response to the score state or the pin-state or points which are increased or decreased depending on such a state is outputted from the console or other equipment.

14 Claims, 45 Drawing Sheets

Fig. 6

| | 1 | 2 | 3 | 4 | 5 | 6 | 7 | 8 | 9 | 10 |
|---|---|---|---|---|---|---|---|---|---|---|
| TAKESHI NAKAO | 3 5 | ✕ | 6 ◢ | 4 3 | 9 - | 7 2 | ✕ | 6 - | 9 ◢ | 4 5 |
| MEDALS: 10 pcs | 8 | 28 | 42 | 49 | 58 | 67 | 83 | 89 | 103 | 112 |
| NAOKO SHIMADA | 7 ◢ | 6 2 | 8 1 | ✕ | 4 5 | 3 4 | 4 4 | G 8 | 3 4 | 3 5 |
| MEDALS: 8 pcs | 16 | 24 | 33 | 52 | 61 | 68 | 76 | 84 | 91 | 99 |
| KOICHI MATSUYAMA | 6 2 | F 4 | ✕ | ✕ | ✕ | 6 ◢ | ✕ | ✕ | ✕ | ✕ 9 ◢ |
| MEDALS: 53pcs | 8 | 12 | 42 | 68 | 88 | 108 | 138 | 168 | 197 | 217 |
| TORU SHIRAI | 4 2 | 6 3 | 7 ◢ | ✕ | 4 5 | G 7 | 1 6 | 4 5 | ✕ | 5 ◢ 3 |
| MEDALS: 12 pcs | 6 | 15 | 35 | 54 | 63 | 70 | 77 | 86 | 106 | 122 |

GAME 1

Please select and press an operation key

NEXT GAME

SCORE CORRECT

GAME RECKONING

Fig. 7B

| | 1 | 2 | 3 | 4 | 5 | 6 | 7 | 8 | 9 | 10 | TOTAL | MEDAL COUNT / PREMIUM |
|---|---|---|---|---|---|---|---|---|---|---|---|---|
| NAKAO | 3 5 | ⋈ | 6 ◢ | 4 3 | 9 - | 7 2 | ⋈ | 6 - | 9 ◢ | 4 5 | | 10 pcs |
| | 8 | 28 | 42 | 49 | 58 | 67 | 83 | 89 | 103 | 112 | 112 | |
| SHIMADA | 7 ◢ | 6 2 | 8 1 | ⋈ | 4 5 | 3 4 | 4 4 | G 8 | 3 4 | 3 5 | | 8 pcs |
| | 16 | 24 | 33 | 52 | 61 | 68 | 76 | 84 | 91 | 99 | 99 | |
| MATSUYAMA | 6 2 | F 4 | ⋈ | ⋈ | ⋈ | 6 ◢ | ⋈ | ⋈ | ⋈ | ⋈ 9 | ◢ | 53 pcs JUICE TICKET |
| | 8 | 12 | 42 | 68 | 88 | 108 | 138 | 168 | 197 | 217 | 217 | |
| SHIRAI | 4 2 | 6 3 | 7 ◢ | ⋈ | 4 5 | G 7 | 1 6 | 4 5 | ⋈ | 5 ◢ | 3 | 12 pcs |
| | 6 | 15 | 35 | 54 | 63 | 70 | 77 | 86 | 106 | 119 | 119 | |

Thank you for your coming to our alley!

Fig. 8B

| | 1 | 2 | 3 | 4 | 5 | 6 | 7 | 8 | 9 | 10 | TOTAL | MEDAL COUNT |
|---|---|---|---|---|---|---|---|---|---|---|---|---|
| NAKAO | 3 5 | ✖ | 6 ◢ | 4 3 | 9 - | 7 2 | ✖ | 6 - | 9 ◢ | 4 5 | | 10 pcs |
| | 8 | 28 | 42 | 49 | 58 | 67 | 83 | 89 | 103 | 112 | 112 | |
| SHIMADA | 7 ◢ | 6 2 | 8 1 | ✖ | 4 5 | 3 4 | 4 4 | G 8 | 3 4 | 3 5 | | 8 pcs |
| | 16 | 24 | 33 | 52 | 61 | 68 | 76 | 84 | 91 | 99 | 99 | |
| MATSUYAMA | 6 2 | F 4 | ✖ | ✖ | ✖ | 6 ◢ | ✖ | ✖ | ✖ | ✖ 9 | ◢ | 53 pcs |
| | 8 | 12 | 42 | 68 | 88 | 108 | 138 | 168 | 197 | 217 | 217 | |
| SHIRAI | 4 2 | 6 3 | 7 ◢ | ✖ | 4 5 | G 7 | 1 6 | 4 5 | ✖ | 5 ◢ | 3 | 12 pcs |
| | 6 | 15 | 35 | 54 | 63 | 70 | 77 | 86 | 106 | 119 | 119 | |

LANE TOTAL: 83 pcs

PREMIUM: TWO-COLOR BALLPOINT PEN

Thank you for your coming to our alley!

Fig. 26B

| | 1 | 2 | 3 | 4 | 5 | 6 | 7 | 8 | 9 | 10 | TOTAL | PREMIUM |
|---|---|---|---|---|---|---|---|---|---|---|---|---|
| NAKAO | 3 5 | ⋈ | 6 ◢ | 4 3 | 9 - | 7 2 | ⋈ | 6 - | 9 ◢ | 4 5 | | |
| | 8 | 28 | 42 | 49 | 58 | 67 | 83 | 89 | 103 | 112 | 112 | — |
| SHIMADA | 7 ◢ | 6 2 | 8 1 | ⋈ | 4 5 | 3 4 | 4 4 | G 8 | 3 4 | 3 5 | | |
| | 16 | 24 | 33 | 52 | 61 | 68 | 76 | 84 | 91 | 99 | 99 | — |
| MATSUYAMA | 6 2 | F 4 | ⋈ | ⋈ | ⋈ | 6 ◢ | ⋈ | ⋈ | ⋈ | ⋈ 9 | ◢ | COFFEE TICKET |
| | 8 | 12 | 42 | 68 | 88 | 108 | 138 | 168 | 197 | 217 | 217 | |
| SHIRAI | 4 2 | 6 3 | 7 ◢ | ⋈ | 4 5 | G 7 | 1 6 | 4 5 | ⋈ | 5 ◢ | 3 | |
| | 6 | 15 | 35 | 54 | 63 | 70 | 77 | 86 | 106 | 119 | 119 | — |

Thank you for your coming to our alley!

Fig. 27B

| | 1 | 2 | 3 | 4 | 5 | 6 | 7 | 8 | 9 | 10 | TOTAL |
|---|---|---|---|---|---|---|---|---|---|---|---|
| NAKAO | 3 5 | ⋈ | 6 ◢ | 4 3 | 9 - | 7 2 | ⋈ | 6 - | 9 ◢ | 4 5 | |
| | 8 | 28 | 42 | 49 | 58 | 67 | 83 | 89 | 103 | 112 | 112 |
| SHIMADA | 7 ◢ | 6 2 | 8 1 | ⋈ | 4 5 | 3 4 | 4 4 | G 8 | 3 4 | 3 5 | |
| | 16 | 24 | 33 | 52 | 61 | 68 | 76 | 84 | 91 | 99 | 99 |
| MATSUYAMA | 6 2 | F 4 | ⋈ | ⋈ | ⋈ | 6 ◢ | ⋈ | ⋈ | ⋈ | ⋈ 9 | ◢ |
| | 8 | 12 | 42 | 68 | 88 | 108 | 138 | 168 | 197 | 217 | 217 |
| SHIRAI | 4 2 | 6 3 | 7 ◢ | ⋈ | 4 5 | G 7 | 1 6 | 4 5 | ⋈ | 5 ◢ | 3 |
| | 6 | 15 | 35 | 54 | 63 | 70 | 77 | 86 | 106 | 119 | 119 |

LANE TOTAL 547

PREMIUM: COFFEE TICKET

Thank you for your coming to our alley!

Fig. 31A
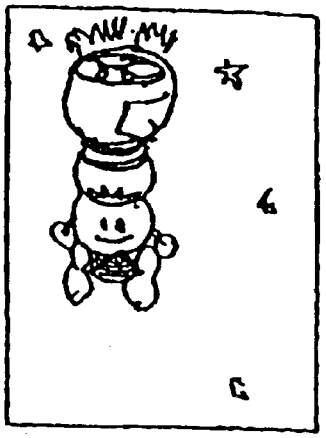
Fig. 31D
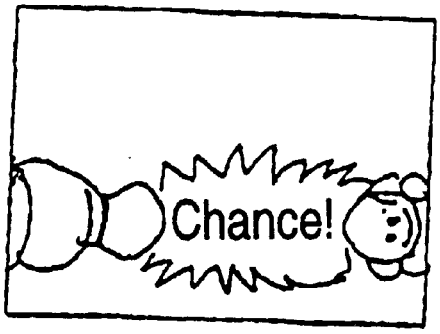
Fig. 31B
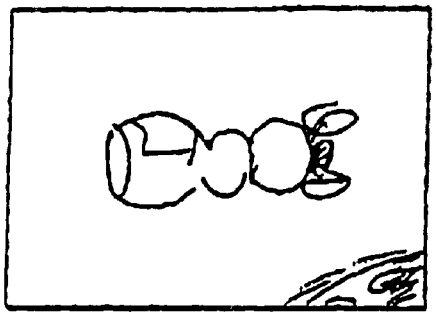
Fig. 31E
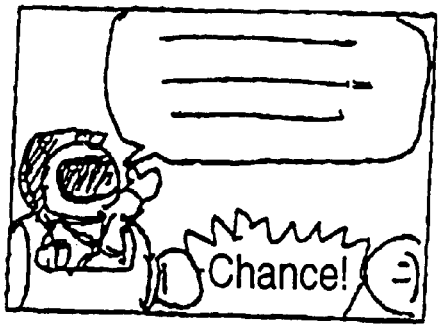
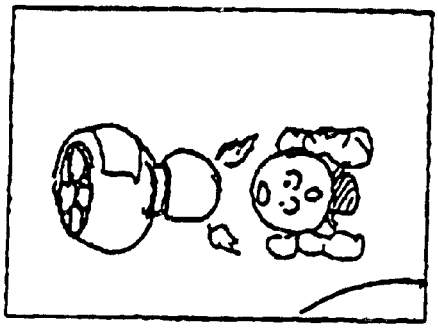
Fig. 31C

AUTOMATIC BOWLING SCORING APPARATUS AND BOWLING ALLEY MANAGEMENT SYSTEM

RELATED APPLICATION DATA

This is a continuation of application Ser. No. 08/837,990, filed Apr. 15, 1997, pending.

BACKGROUND OF THE INVENTION

1. Field of the Invention

The present invention relates to an automatic bowling scoring apparatus for automatically executing the scoring process of a bowling game, a bowling alley management system for automatically executing the management in a bowling alley, and a service information output method for a bowling alley.

2. Description of the Prior Art

In conventionally common bowling alleys, there is provided an automatic bowling scoring apparatus which comprises means for detecting the number of pins that have been fell down by a bowl, and means for automatically executing score calculation in response to the state of fell-down pins and displaying the result onto a CRT or the like. The provision of this automatic bowling scoring apparatus allows customers to devote themselves to the games, while it contributes to smooth progress of bowling games so that the rate of turnover is improved.

With the conventional automatic bowling scoring apparatus, indeed the bowling games will progress smoothly as a whole so that the rate of turnover of the bowling alley can be expected to improve, but the way of enjoying the bowling game or its enjoyment itself for customers is not so much changed, such that the bowling game has been a game the sportiveness of which is to be enjoyed primarily. However, even for such a game of high sportiveness, there has been a demand for adding new attractions to the existing sportiveness in order to obtain, for example, such pulling power that those weak in the bowling can also be customers.

An object of the present invention is therefore to provide an automatic bowling scoring apparatus, as well as a bowling alley management system, which can make the bowling game itself more exciting besides the pleasure attributable to the competition of the score of bowling games.

SUMMARY OF THE INVENTION

The operations of the invention will be described with reference to FIGS. 38 and 39, which are their schematic arrangement views.

With the automatic bowling scoring apparatus or with the service information output method of the bowling alley, a service-use medium that has recorded service information offered to the customer in response to the score counting result or the pin-state detection result is outputted. Upon a strike as one example, or in response to the score at the end of the game as another example, for instance, a receipt for exchange with gifts is printed out as shown in FIG. 38A. Otherwise, a service medium such as medals or balls in a number corresponding to the contents of the service is discharged. Also with the automatic bowling scoring apparatus or with the service information output method for a bowling alley, a service medium which has recorded service information that has been determined by a specified probability during the bowling game and that is to be offered to the customer is outputted. For example, through the steps of generating a specified random number at some timing of the bowling game, such as a bowling of the ball, and determining the service information to be offered to the customer in response to the random number, a service medium is outputted. Also with the automatic bowling scoring apparatus or with the service information output method for a bowling alley, for example, upon a strike or a spare or a coincidence of the score pattern with a predetermined pattern, points other than the score of the bowling game are increased or decreased in response to the score counting result or the pin-state detection result. Also with the automatic bowling scoring apparatus or with the service information output method for a bowling alley, points other than the score of the bowling game are increased or decreased at a specified probability, and a service medium that has recorded information on the service offered to the customer in response to the points or the service medium in a number corresponding to the contents of the service in response to the points is outputted.

Further with the automatic bowling'scoring apparatus or with the service. information output method for a bowling alley, another pastime such as slot machine, roulette, and sugoroku (a Japanese variety of Parcheesi) is displayed on a display device in response to the score state, the pin state, or a specified probability, where points other than the score of the bowling game are increased or decreased on condition that the contents of this pastime have come to a predetermined state. Then, information on the service offered to the customer in response to the points obtained in this way is recorded to the service medium. For instance, in response to the points at the end of the game, a receipt for exchange with gifts as an example is printed out as shown in FIG. 38A. Otherwise, a service medium such as medals or balls in a number corresponding to the contents of the service is discharged. The customer is allowed to exchange the gift-exchange use receipt or medals or the like for a gift at the front or the like, by which the customer can receive a gift. This can arouse customers' passion for gambling so as to enhance the customers excitement for the bowling game.

Also with the automatic bowling scoring apparatus, a plurality of service contents are displayed in a list in response to the points obtained by the bowling game or another pastime accompanying the bowling game, allowing the customer to make a selective operation, where information on the service selected is printed out. For example as shown in FIG. 38B, a plurality of exchangeable gifts are displayed in a list in response to the points, where a gift-exchange use receipt is printed out according to the selection. In this way, the gifts as an aim add to the pleasure of the bowling game so that customers are attracted, while the procedure of exchanging with gifts is partly automatized so that the working burden on the bowling alley side is reduced.

Also with the automatic bowling scoring apparatus, the contents of service for customers are printed out along with the score of the bowling game. For example, at the end of the bowling game, such a score sheet as shown in FIG. 38C is outputted from the console, where the customers carry the score sheet to the front or the like to receive the service of exchange with gifts or the like.

Also with the bowling alley management system, the information on service to be offered to the customer in response to a score counting result or a pin-state detection result, the score counting result, or. the pin-state detection result is transferred to the host unit. Upon a strike. as one example, or in response to the score at the end of the game as another example, for instance, a service medium on which the information on the service to be offered to the customer is printed is outputted as shown in FIG. 38D. Also with the bowling alley management system, information on the service to be offered to the customer, which has been determined with a specified probability during the bowling game, is transferred to the host unit. For example, a specified random number such as a bowling of the ball is generated at some timing of the bowling game, and the service information to be offered to the customer is determined in response to the random number. Also with the bowling alley management system, for example, upon a strike or a spare or a coincidence of the score pattern with a predetermined pattern, points other than the score of the bowling game are increased or decreased in response to the score counting result or the pin-state detection result. Also with the bowling alley management system, points other than the score of the bowling game are increased or decreased at specified probabilities on the console. With the bowling alley management system, another pastime such as slot machine, roulette, and sugoroku is displayed on a display device in response to the score state or the pin state or at a specified probability, where points other than the score of the bowling game are increased or decreased on the console on condition that the contents of this pastime have come to a predetermined state. Then, as shown in FIG. 38D, information on the service offered to the customer in response to the points or the points themselves are transferred to the host unit, and received by the host unit, where a service medium on which the information on the service offered to the customer is printed is outputted. The host unit, if provided at the front or the like, allows services such as offering customers gifts to be carried out in response to the contents of the service medium outputted at the front.

Also with the bowling alley management system, as shown in FIG. 38E, a plurality of service contents are displayed in a list in response to the points on the console side, where a selective operation by the customer is read and the information on the selected service is transferred to the host unit. Thus, the customer is enabled to select from among the service contents, while the content of the selection can be grasped on the host unit side.

Further with the bowling alley management system, as shown in FIG. 38F, points transmitted from the console are received by the host unit, where a plurality of service contents responsive to the points are displayed in a list, enabling the operation of selection therefrom to be carried out on the host unit side.

Also with the bowling alley management system, the score of the bowling game is printed on the host unit side, where the contents of the service to be offered to the customer are printed in part of the printout as shown in FIG. 38C. Thus, the contents of the service to be offered to the customers can be recorded and confirmed without printing any special sheet.

Also with the bowling alley management system, information on service to be offered to the customer in response to the score counting result or the pin-state detection result, or the score counting result is written into a service medium such as a memory card or magnetic card, for example as shown in FIG. 39A. The contents of this service medium are read by a medium content output unit, and displayed or printed. Also with the bowling alley management system, information on the service determined at a specified probability during the bowling game is written into the service medium. Also with the bowling alley management system, for example, upon a strike or a spare or a coincidence of the score pattern with a predetermined pattern, points other than the score of the bowling game are increased or decreased in response to the score counting result or the pin-state detection result on the console. Also with the bowling alley management system, points other than the score of the bowling game are increased or decreased at specified probabilities on the console. With the bowling alley management system, points other than the score of the bowling game are increased or decreased at specified probabilities. With the bowling alley management system, another pastime such as slot machine, roulette, and sugoroku is displayed on a display device in response to the score state, the pin state, or a specified probability, where points other than the score of the bowling game are increased or decreased on the console on condition that the contents of this pastime have come to a predetermined state. Then, as shown in FIG. 39A, information on the service offered to the customer in response to the points obtained in this way or the points themselves are written into a service medium such as a memory card or magnetic card. The service information or points are read from the service medium by a medium-content output unit, and displayed or printed. The medium-content output unit, if provided at the front, makes it possible that the card is received from the customer and read by the medium-content output unit after the end of the bowling game, so that service is offered.

Further with the bowling alley management system, as shown in FIG. 39B, a plurality of service contents are displayed in a list in response to the points on the console side, and information on service selected by the customer is written into a service medium such as a magnetic card. Thus, the customer is allowed to receive desired service by making the service medium read by a medium-content output unit.

Also with the bowling alley management system, as shown in FIG. 39C, a plurality of service contents are displayed in a list in response to points read from a service medium such as a magnetic card on the medium-content output unit side, and information on service selected is displayed or printed. If the medium content output unit is provided, for example, at the front, the content of the service can be determined through an operation by a front clerk. Otherwise, such an operation is also possible that the medium-content output unit is provided at a location that allows customers to select a service content, so that a gift-exchange use receipt as an example is outputted in response to the selective operation by a customer and exchanged with a gift.

Also with the bowling alley management system, a portion of the points corresponding to the service that has been offered to the customer is subtracted from the service medium such as a card. Thus, it becomes possible to divisionally offer different types of services or the same type of service in several times.

Also with the bowling alley management system, information on service to be offered to the customer in response to the score counting result or the pin-state detection result, or the score counting result is transferred to the host unit, or with the bowling alley management system, information on service that has been determined at a specified probability during the bowling game is transferred to the host unit, as shown in FIG. 39D. Then, the information or the like is received by the host unit, and the information on the service to be offered to the customer is written into a service medium such as a memory card. Meanwhile, the service information is displayed on the display section or printed on the host unit. Also with the bowling alley management system, for example, upon a strike or a spare or a coincidence of the score pattern with a predetermined pattern, points other than the score of the bowling game are increased or decreased in response to the score counting result or the pin-state detection result on the console. Also with the bowling alley management system, points other than the score of the bowling game are increased or decreased at specified probabilities. Also with the bowling alley management system, another pastime such as slot machine, roulette, and sugoroku can be displayed on a display device in response to the score state, the pin state, or a specified probability, where points other than the score of the bowling game are increased or decreased on the console on condition that the contents of this pastime have come to a predetermined state. Then, as shown in FIG. 39D, the points. are transmitted to and received by the host unit, where information on the service offered to the customer or the points are written into a service medium such as a magnetic card. Further, in the host unit, the service information or points are displayed on the display section or printed. For example, upon completion of the bowling game, the information on the service to be offered to the customer or the points themselves are written into the customer's service medium such as a magnetic card by the host unit provided at the front. Also, when the service medium is read by the host unit, the information on the read service or points are displayed or printed. Thus, service for customers is enabled on the basis of the service medium without providing any card reader/writer or the like on the console side.

BRIEF DESCRIPTION OF THE DRAWINGS

FIG. 6 is a view showing a display example on the console;

FIG. 31 is a view showing an example of notice display of a specific state;

DETAILED DESCRIPTION OF THE PREFERRED EMBODIMENTS

The arrangements of an automatic bowling scoring apparatus, as well as a service information output method for a bowling alley, are described hereinbelow with reference to FIGS. 1 to 14.

Figure 1:
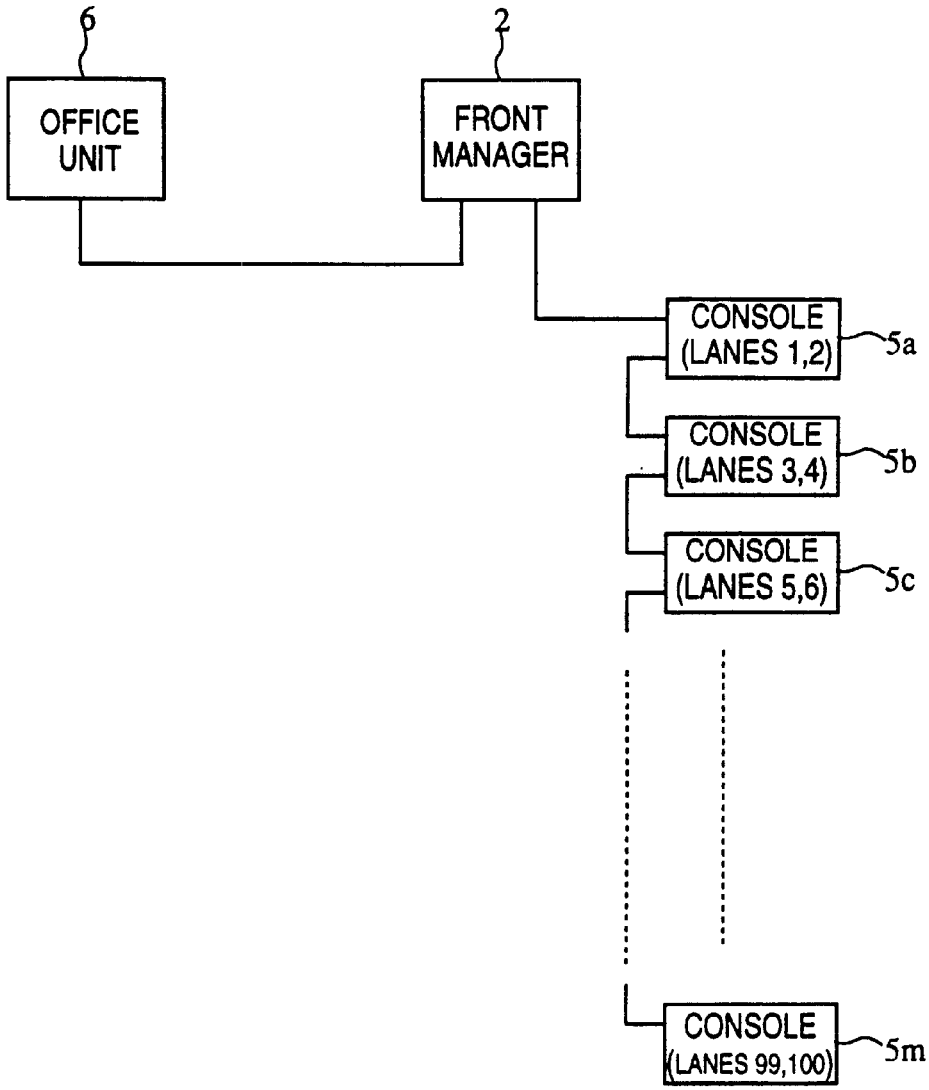
FIG. 1 is a block diagram showing the overall arrangement of a bowling alley management system according to the first embodiment.

FIG. 1 is a block diagram showing the overall arrangement of the bowling alley management system. In this case, consoles 5*a*, 5*b*, 5*c*, . . . , 5*m* provided for every two lanes, a host unit (hereinafter, referred to as front manager) 2, and an office unit 6 provided in the office are connected together via a local area network.

Figure 2:
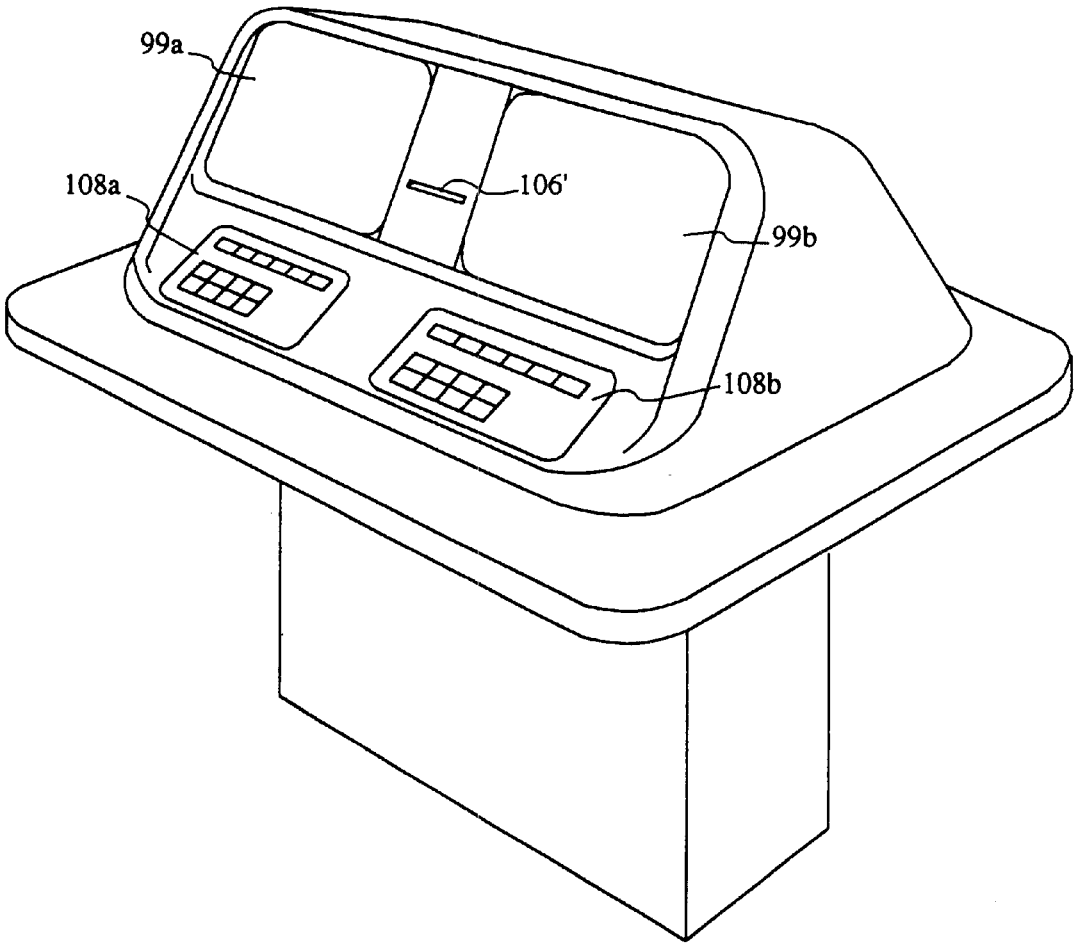
FIG. 2 is a perspective view of the appearance of the console.

FIG. 2 is an appearance perspective view showing the arrangement of the console. Referring to FIG. 2, numerals 99*a*, 99*b* each denote a CRT for displaying the score as well as points other than the score and the contents of another pastime, and numerals 108*a*, 108*b* each denote a keyboard used for the correction of the names of bowlers, the correction of the score, and the like. Numeral 106' denotes a paper outlet of the printer for outputting score sheets and the like, where the printer is shared by right and left lanes.

Figure 3:
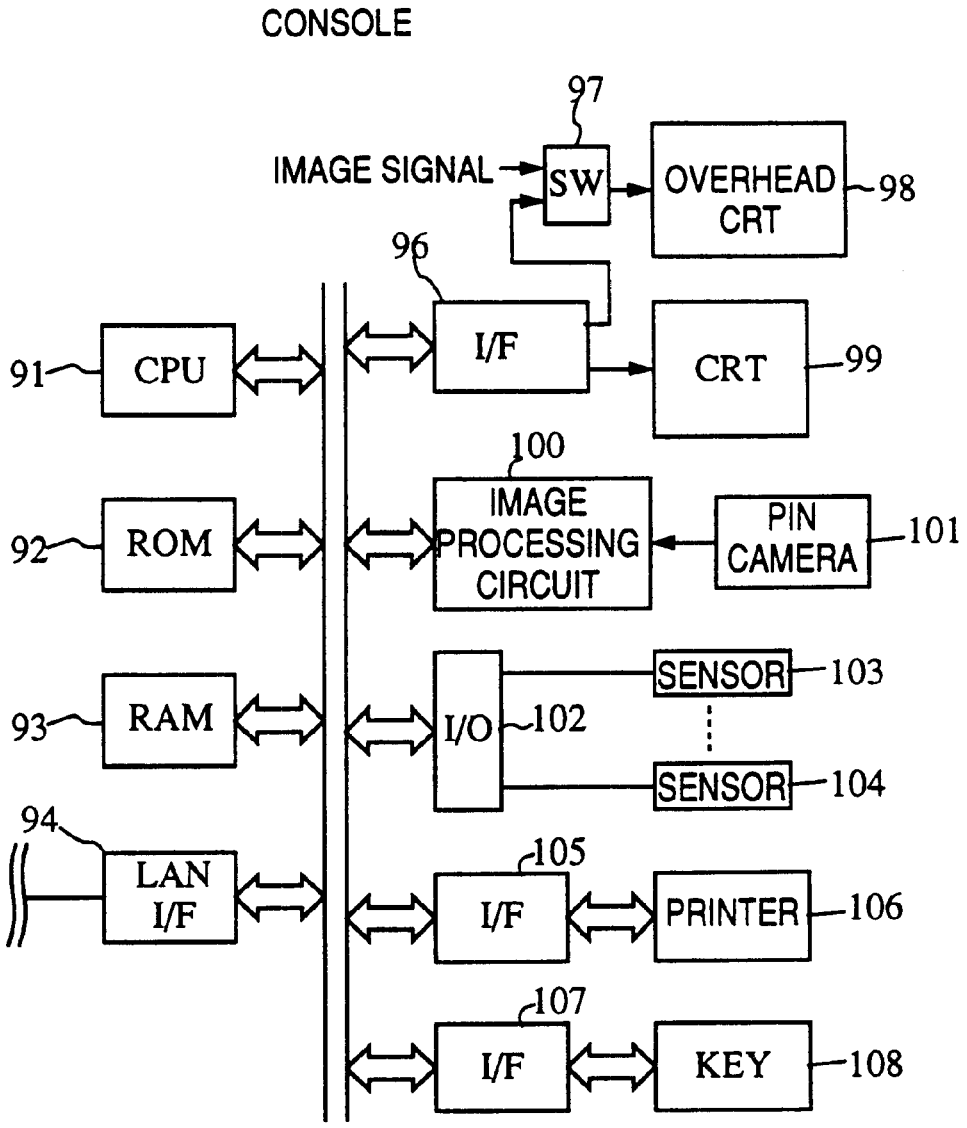
FIG. 3 is a block diagram showing the arrangement of the console.

FIG. 3 is a block diagram of the part that executes the score processing for one lane by one console out of the consoles 5*a* to 5*m* shown in FIG. 1. ACPU 91 executes programs previously written in a ROM 92. A RAM 93 is used as various types of working areas for temporary storage of score information during the execution of the programs. A LAN interface 94 is a circuit for interfacing with a local area network, and executes the transfer control of various data in conjunction with the front manager or the like via the local area network. An overhead CRT 98, which is a large-size CRT provided above the approach, displays the score, pin actions, and other images. A switch circuit 97 executes the selection between image signals derived from a display interface 96 and the other image signals. The display interface 96, which has display memory, gives a display signal to the overhead CRT 98 via a CRT 99 and the switch 97, in response to the contents of the display memory. The CRT 99, which is a display section provided in the main body of the console as shown in FIG. 2, displays, for example, a message representing that the score display and the score have come to a specific state. A pin. camera 101 picks up the image of positional arrangement of bowling pins, while an image processing circuit 100 executes certain image processing on the image signal to generate digital image data. The CPU 91 reads the resulting digital image data to detect an erect/down state of the bowling pins. Sensors 103, . . . , 104 are ball passage sensors and foul sensors provided at specified positions on the lane, where the CPU 91 reads the state of the various sensors via an I/O port 102. A printer 106 is used to print out the score, where the CPU 91 outputs print data via an interface 105. A keyboard 108 is used for effecting the correction of the names of bowlers from the console side or at an end of the game, where the CPU 91 reads the contents of such key operations via an interface 107. It is noted that the CRT 99,is not essential, where only the overhead CRT 98, for example, may be used as the display section of the console so that the console main body is reduced in size.

Figure 4:
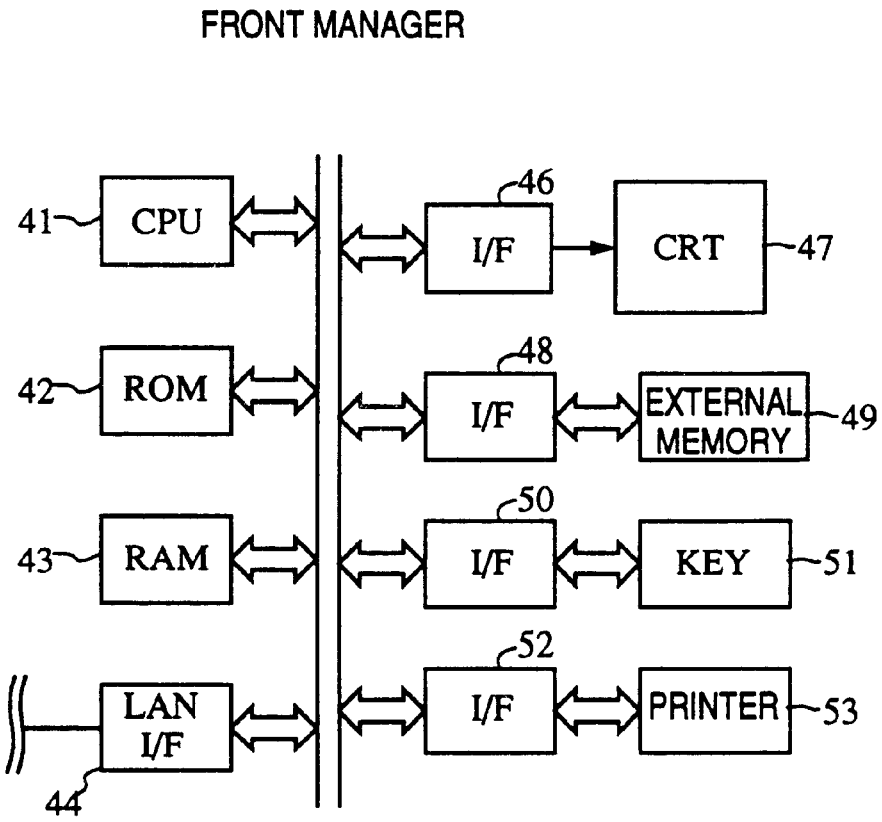
FIG. 4 is a block diagram showing the arrangement of the front manager.

FIG. 4 is block diagram showing the arrangement of the front manager. A CPU 41 executes a program previously written in a ROM 42, while it loads a program that has been saved in an external memory 49 to a RAM 43 to execute the program. The RAM 43 is used as various working areas in executing the program. ALAN interface 44 is an interface circuit in conjunction with a local area network, and executes the transfer control of various data in conjunction with the consoleor the like via the local area network. A display interface 46, which has display memory, outputs a display signal for a CRT 47. The external memory 49 is an external storage device such as a hard disk unit, while the CPU 41 performs the read/write of various data via an interface 48. A keyboard 51 is used for the setting input of data that include the input of identification information such as the names of bowlers, input for designating the charge reckoning, and what points are given in what state of score (hereinafter, the data will be referred to as gift data), and the like. The CPU 41 reads the contents of key operations via an interface 50. A printer 53 is used to print score sheets or the like on the front manager side. The cPu 41 outputs print data via an interface 52.

Figure 5A:
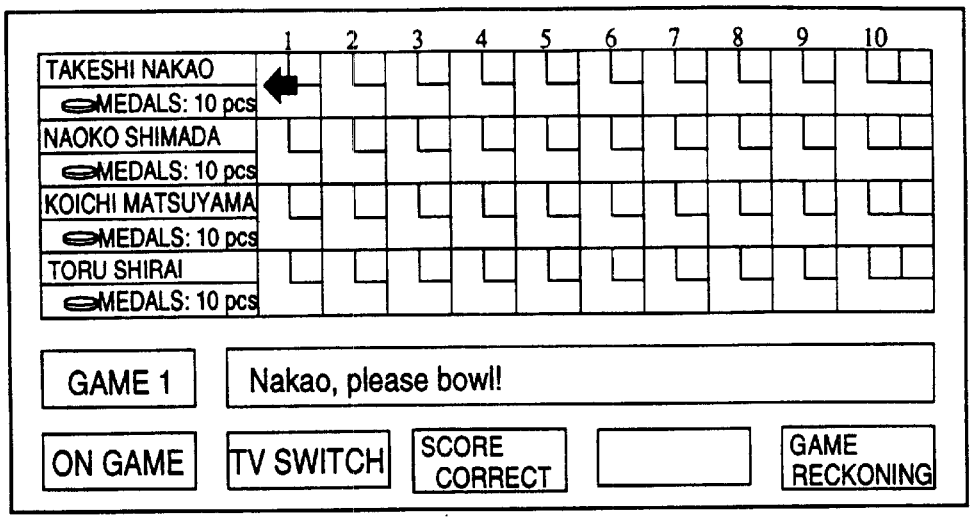
FIG. 5 is a view showing a display example on the console.
Figure 5B:
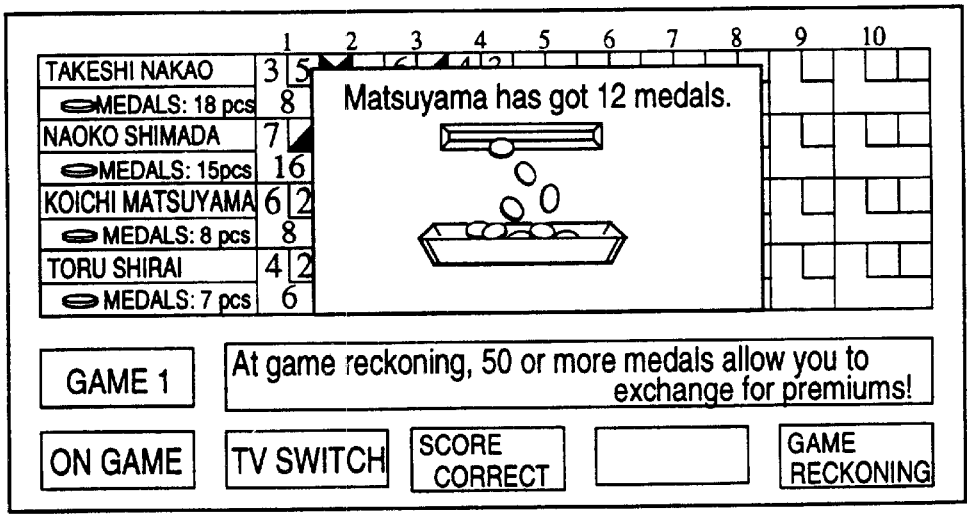
Figure 5C:
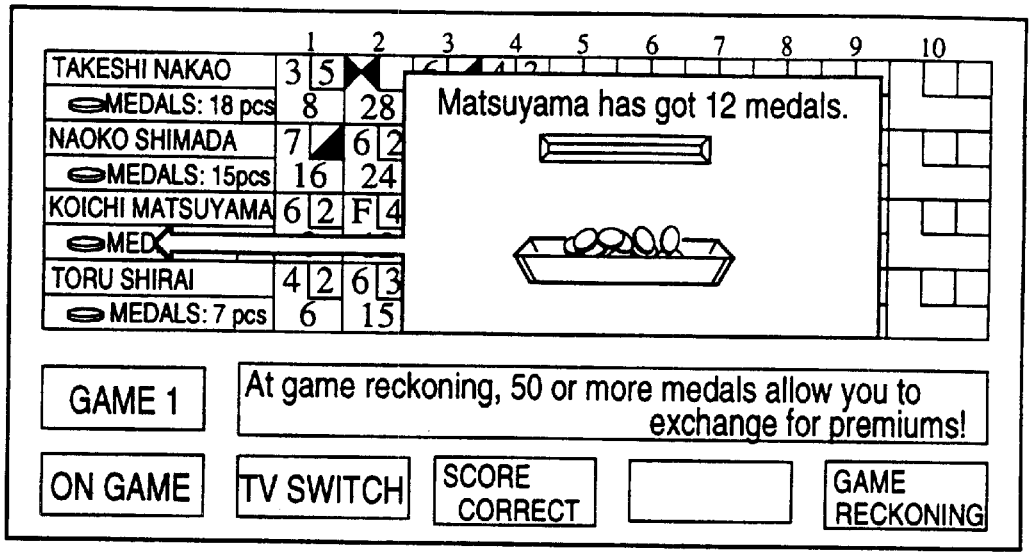

FIGS. 5 and 6 are view showing display examples on the console. FIG. 5A is a display example of the initial screen at the start of a bowling game, where the score is displayed for each bowler and the number of medals is displayed for each bowler. In this example, it is shown that ten medals have previously been given to each of four bowlers. In this example, points other than the score of the bowling game are shown as the number of medals, so that the number of medals acquired by each bowler equals the value of the points obtained. This number of medals is decremented by one each time one frame is completed, whereas the occurrence of a strike or spare causes a predetermined number of medals to be added responsively. Accordingly, the number of medals acquired will change in response to the moving conditions of the game. In addition, the arrow in the score display shows the bowler designated for the next bowl. FIG. 5B is a display example during the game, and FIG. 5C is a display example subsequent to FIG. 5B. These show that a bowl by the third bowler (Koichi Matsuyama) has been a strike so that discharging four medals is simulatively displayed, with the result that Matsuyama's number of medals at the end of the fourth frame has become 12. At such a simulative display of medal discharge, a merry effective sound will be produced. This can make customers more excited. FIG. 6 is a display example at a time point when the four bowlers have completed one game. In this case, for an end of the bowling game, a function key corresponding to the display field where "game account" is displayed is operated out of the four function keys in the figure. For the next game, a function key corresponding to the display field where "next game" is displayed is operated.

Figure 7A:
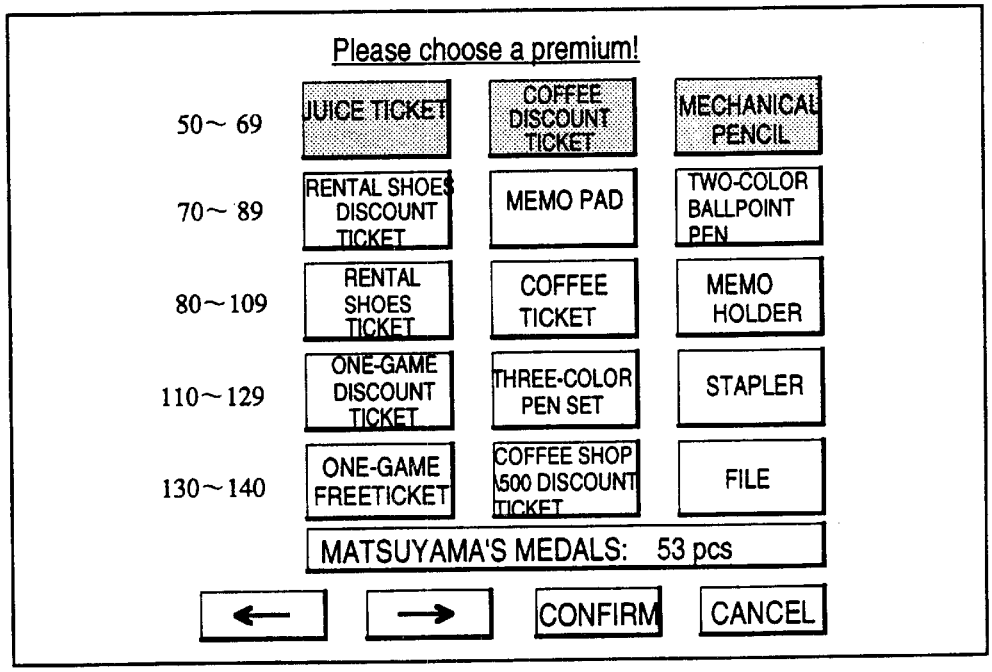
FIG. 7 is a view showing a display example on the console as well as a printout example of the score sheet.

FIG. 7A shows a display example of the gift selection screen on the console, and FIG. 7B is a printout example of the score sheet on the console. In the state shown in FIG. 6, operating the function key of game account causes the screen to change to the display of gift selection screen as shown in FIG. 7A. This gift selection screen is presented for each bowler that has acquired 50 or more points (number of medals). In the example shown in FIG. 7A, since the number of medals that the bowler, Koichi Matsuyama, has acquired is 53, the designations of gifts exchangeable with the number of acquired medals in the range of 50 to 69 are displayed in a color different from that of the other gifts. In this state, operating a function key indicated by arrows, which serve as functional indication, in lower part of the screen causes the cursor to be focused on one cursor display position (the position displayed in a color different from that of the other gifts), in which screen the cursor display position will move each time a function key corresponding to the arrow key is operated from now on. Then, by operating a function key serving as the confirmation key, the gift shown by the cursor is selected. After each bowler has selected gifts in the gift selection screen as shown in FIG. 7A displayed for each of the bowlers that have acquired 50 or more medals, a score sheet is printed out together with the designations of the gifts selected by the bowlers.

Figure 8A:
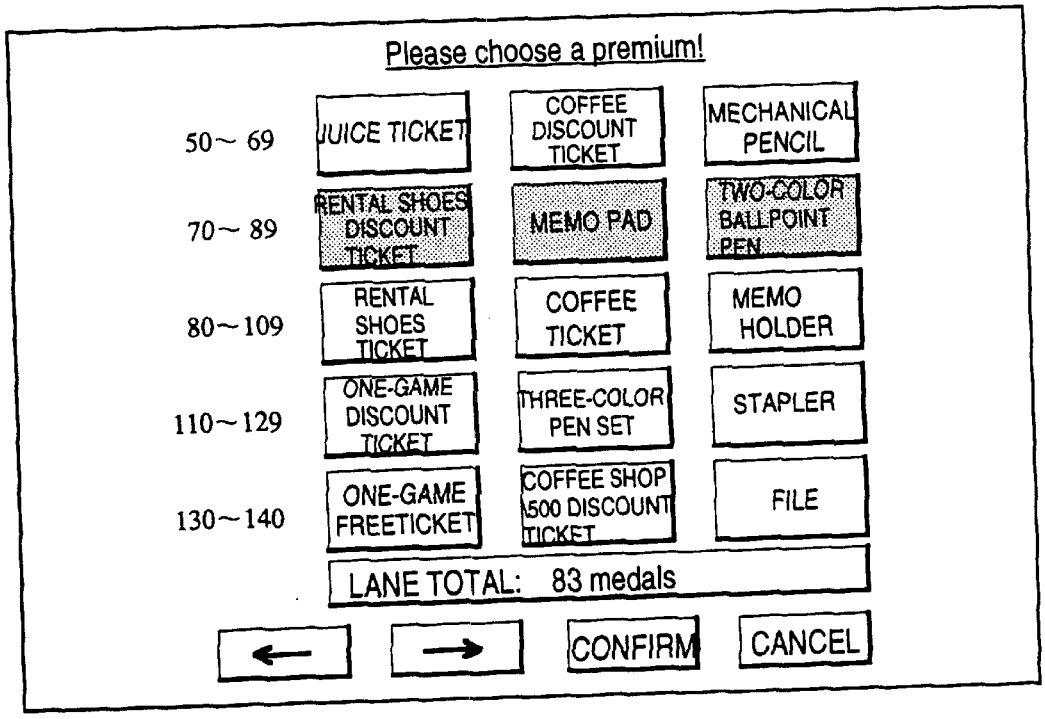
FIG. 8 is a view showing a display example on the console as well as a printout example of the score sheet.

FIG. 8A is a display example of the gift selection screen on another console, and FIG. 8B is a printout example of another score sheet on the console. Unlike the example shown in FIG. 7, this example shows a case in which the gift selection is effected in response to the total of the numbers of medals acquired by the bowlers in the pertinent lane. More specifically, as shown in FIG. 8A, because the total number of medals acquired by four bowlers in this lane is 83, the designations of gifts exchangeable with 70 to 89 medals are displayed in a color different from that of the other gifts. In this state, like the foregoing case, if the function key for cursor movement is operated so that the cursor is moved to, for example, the position of two-color ballpoint pens, and if the function key serving as the confirmation key is operated, then the designation of the gift is printed out on the score sheet as shown in FIG. 8B.

Figure 9:
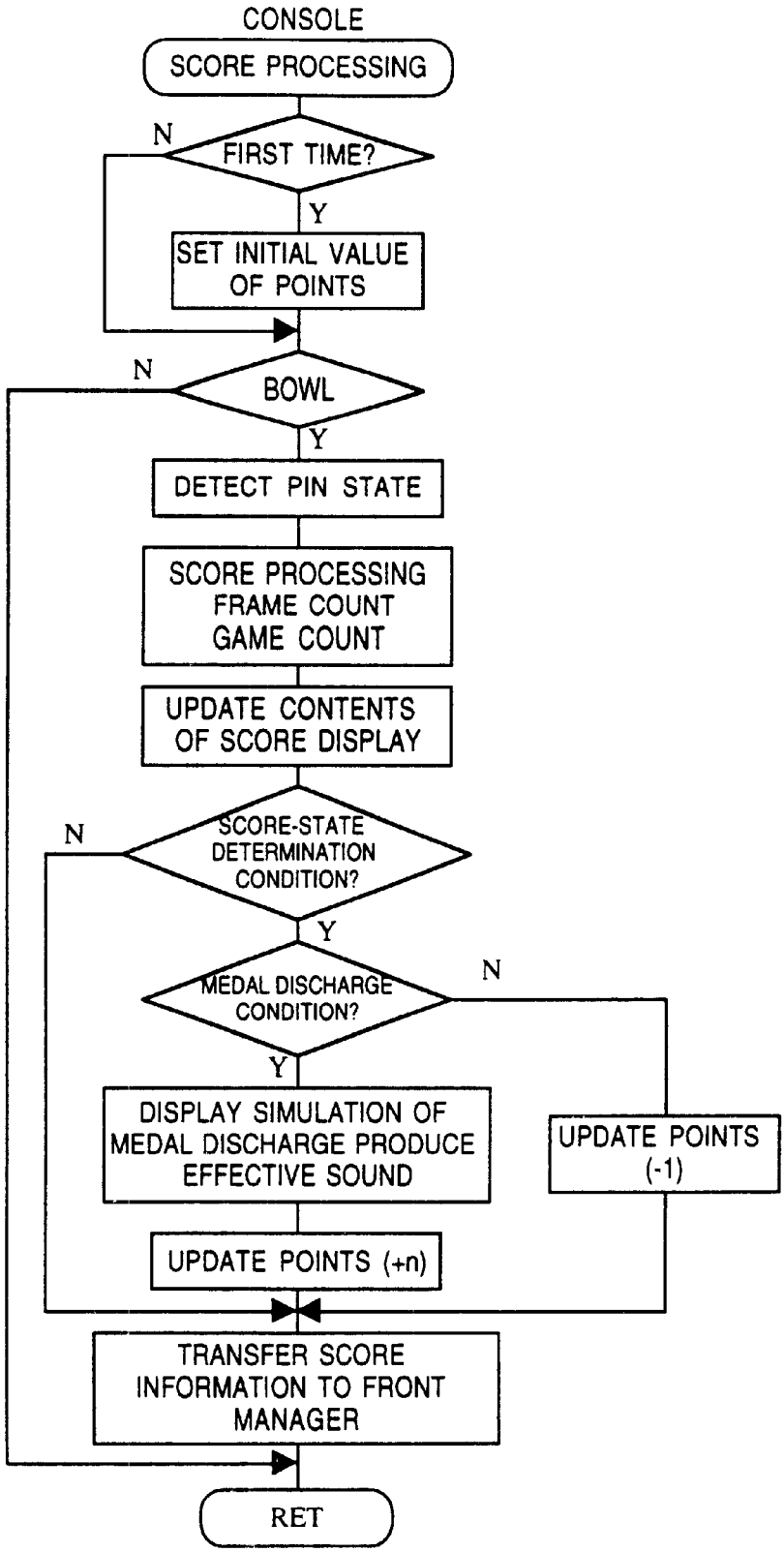
FIG. 9 is a flow chart showing the procedure of score processing by the console.

FIG. 9 is a flow chart showing the contents of score processing by the console. In the console, for example, a point of 10 is first set as the initial point for each bowler and, upon each bowl, the resulting pin state is detected and the score processing as well as the counting of frame number or game number are effected based on the detected pin state. Subsequently, the contents of the score display are updated responsively, where if the current score state or pin state has come to a predetermined state (e.g., a spare, a strike, or a succession of strikes) under a condition of score state determination (e.g., upon a bowl, an end of one-frame bowls, or an end of 10 frames), then a specified point is added to the point of the. pertinent bowler, followed by the simulative display of discharging medals in a number corresponding to the added-up point, and by the updating of the, point display. During this process, a medal-discharge effective sound is produced in accompaniment to the simulative display of medal discharge. If the current score state or pin state has not come to the predetermined state under the condition of score state determination, 1 is subtracted from the point of the pertinent bowler. After that, score information including the point is transferred to the front manager. In this connection, how many points are increased or decreased in what score state or in what pin state is prescribed based on premium data set through a reception from the front manager.

Below listed are examples in which the score counting result is used as the condition on which the point is increased or decreased, or examples in which the point to be incremented or decremented according to the score counting result is determined.

A. Conditioning by the number of specific events to be determined at an end of 10 frames or at each frame, such as:

(1) Occurrence of strikes (double to eleventh) or total of the occurrences;

(2) Occurrence of spares or total of the occurrences;

(3) Occurrence of gutters or misbowls or total of the occurrences; and (4) Simple totals of pins that have been knocked down or not knocked down.

For instance, a specified point is added when the total of strikes exceed a certain value, or otherwise a point responsive to the total of strikes is added.

B. Conditioning by the following score patterns in 1st to 10th frames:

(1) Patterns in which strikes or spares appear:

For instance, depending on whether strikes have occurred in steps of one frame or two frames, whether strikes have occurred in all the frames (i.e., a perfect game), whether spares have occurred in all the frames (all spares), whether or not spares and strikes have occurred alternately, and the like, a specified point is added or points in response to the respective patterns are added.

(2) Patterns in which gutters or misbowls appear

For instance, depending on whether gutters or misbowls have occurred in steps of one frame or two frames or the like, a specified point is added or points responsive to the respective patterns are added.

(3) Patterns of total sums of the frames

For instance, depending on whether or not successive five frames have resulted in the same point (five frames), whether or not successive three frames have resulted in the same point and its succeeding two frames have resulted in the same point (i.e., a full house), whether or not succeeding five frames have changed in steps of *1 (i.e., a straight), and the like, a specified point is added or points responsive to the respective patterns are added.

C. Conditioning by Score Points (1) Conditioning depending on whether or not the score of one game has resulted in a specific value, such as 100, 200, or 300; and (2) Conditioning depending on whether or not the score value has exceeded a specific value within a specific frame count.

For instance, with even-numbered frames taken as the specific frames, points are given on the condition of a low point-increasing tendency in such a way that if the score up to the 2nd frame is less than 5, then a certain point is added at the 3rd frame; if the score up to the 4th frame is less than 15, then a certain point is added at the 5th frame; if the score up to the 6th frame is less than 30, then a certain point is added at the 7th frame; and so on.

D. Conditioning by Degree of Difficulty (1) Depending on the degree of difficulty of pin patterns that have been cleared (spared) or not, the point to be incremented or decremented is determined.

For instance, a high point is added when a pin pattern with a high degree of difficulty such as a 7–10 pin split has been cleared, while a relatively low point is added when a pin pattern with a low degree of difficulty such as a 4–5 pin split has been cleared.

Also, below listed are examples in which the pin-state detection result is used as the condition on which the point is increased or decreased, or examples in which the point to be incremented or decremented according to the pin-state detection result is determined.

E. Conditioning by Patterns of Knocked-down Pins (1) For instance, depending on whether or not the pin pattern has resulted in a specific pattern such as a 7–10 pin split, or the like, a specified point is added or predetermined points responsive to the respective patterns are added.

In addition, bowlers skilled in the bowling will be pleased with increased points on. the ground of their skill, whereas bowlers unskilled in the bowling, conversely, will not be interested in the rules that the points are increased based on such events involving a skill. In order that such unskilled bowlers are interested in the bowling game and pastime games or the like accompanying it, it would be rather better that the point be increased in response to the score counting result on which the poor skill has been reflected. For example, as shown in A (3) above, the more the gutter or misbowl occurs or the larger the total of the occurrences is, the more the point is added; as shown in C (2), the lower the point-increasing tendency is, the more the point is added; or as shown in D (1), the lower the degree of difficulty of pin pattern is than a certain degree, the more the point is added. Such rules may be used in combination with the rules that the point is added under required conditions, offering a variety of enjoyments in response to the skills of the bowlers.

Figure 10:
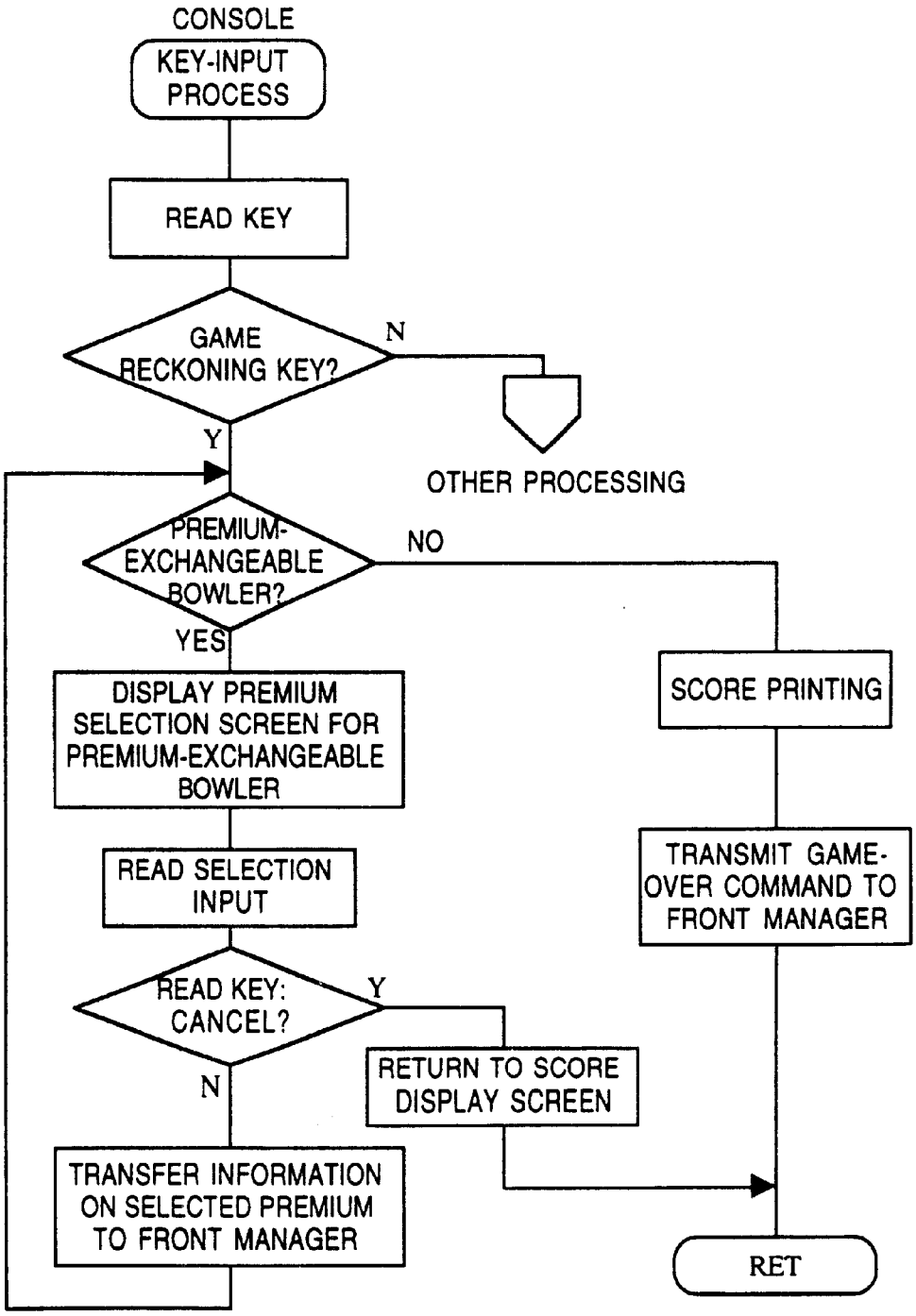
FIG. 10 is a flow chart showing the procedure of key-input process by the console.

FIG. 10 is a flow chart showing the contents of key-input process by the console. Upon some key operation, the console reads it; for example, if the game-account key is operated, the console displays the gift selection screen for a bowler that has acquired a gift-exchangeable point, if any, as shown in FIG. 7A, and reads the selection input by the bowler. As described before, when a function key serving as an arrow key is operated, the cursor display position is moved; when a function key serving as the confirmation key is operated, gift information corresponding to the current cursor position is transferred to the front manager. This operation is iteratively executed on all the bowlers that have acquired gift-exchangeable points, and the score is printed as shown in FIG. 7B. Then, the game-over command is transmitted to the front manager. In addition, if no bowlers have acquired gift-exchangeable points, the gift-exchange selection screen as shown in FIG. 7A will not be displayed but the score is printed as it is. Also, if a function key serving as the cancel key is operated while the gift selection screen is displayed, then the screen turns back to the score display screen as shown in FIG. 6. This makes it possible to stop making a gift exchange and proceed to the next game. With the setting that the more the acquired point increases, the more objectively valuable gifts the point corresponds to as shown in FIG. 7A, the customers would consider, for example, what points should be added to the currently acquired points enough to exchange for one rank higher gifts. This would increase the cases where the customers continuously play the game with the aim of acquiring additional points.

Figure 11:
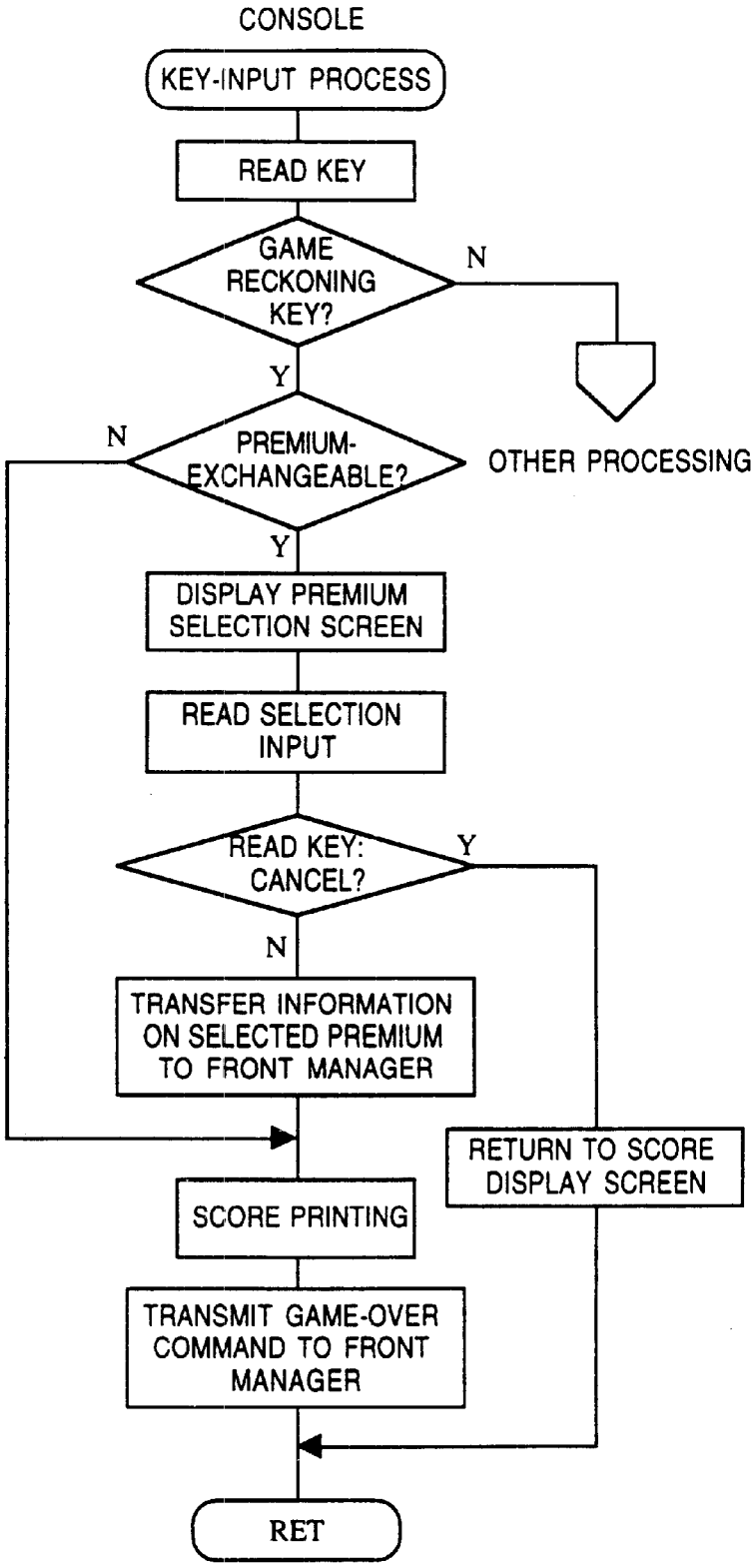
FIG. 11 is a flow chart showing the contents of key-input process by the console.

FIG. 11 is a flow chart showing the contents of another key-input process by the console. FIG. 10 has showed an example in which the gift selection screen is displayed bowler by bowler, whereas in this example of FIG. 11, the gift exchange is carried out in response to the points of the lane total. Upon some key operation, the console reads it; for example, if the game-account key is operated, the console determines whether or not the total point in the lane has reached a gift-exchangeable value, where if it has, the console displays the gift selection screen as shown as in FIG. 8A, awaiting a selection input. As described before, information on the gift selected through operations of a function key serving as an arrow key and a function key serving as the confirmation key is transferred to the front manager, and prints the gift name on the score sheet as shown in FIG. 8B. Then, the game-over command is transmitted to the front manager. In addition, if a function key serving as the cancel key is operated while the gift selection screen is displayed, then the screen turns back to the score screen as shown in FIG. 6, enabling the proceeding of the game.

Figure 12:
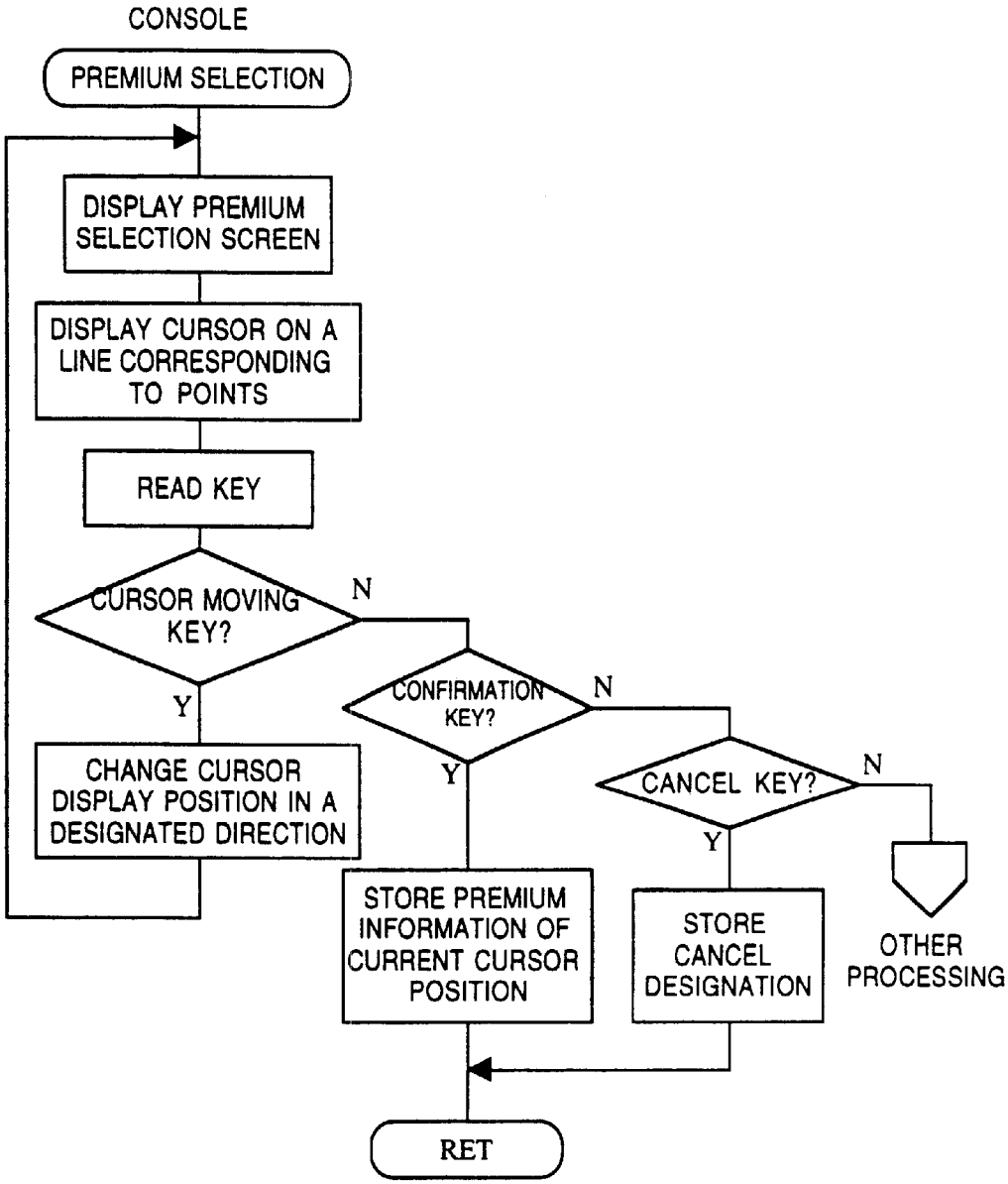
FIG. 12 is a flow chart showing the procedure of gift-selection process by the console.

FIG. 12 is a flow chart showing in a little more detail the display of the gift selection screen as well as the procedure of reading the selection input in FIG. 10 or 11. First, a gift selection screen is displayed as shown in FIG. 7A or 8A, the cursor is displayed at a line corresponding to the point (displayed in a color different from that of the other lines). Subsequently, the console reads the key; for example, if a function key serving as the left arrow key is operated, the cursor is displayed on the left-side gift name out of three gift names in the example shown in FIG. 7 or FIG. 8; otherwise, if a function key serving as the right arrow key is operated, the cursor is displayed on the right-side gift name. Also, if a function key serving as an arrow key is further operated in the state that a single cursor is displayed like this, the cursor display position is changed in that direction. Furthermore, if a function key serving as the confirmation key is operated, gift information shown by the current cursor position is stored. If a function key serving as the cancel key is operated, the key operation is stored.

Figure 13:
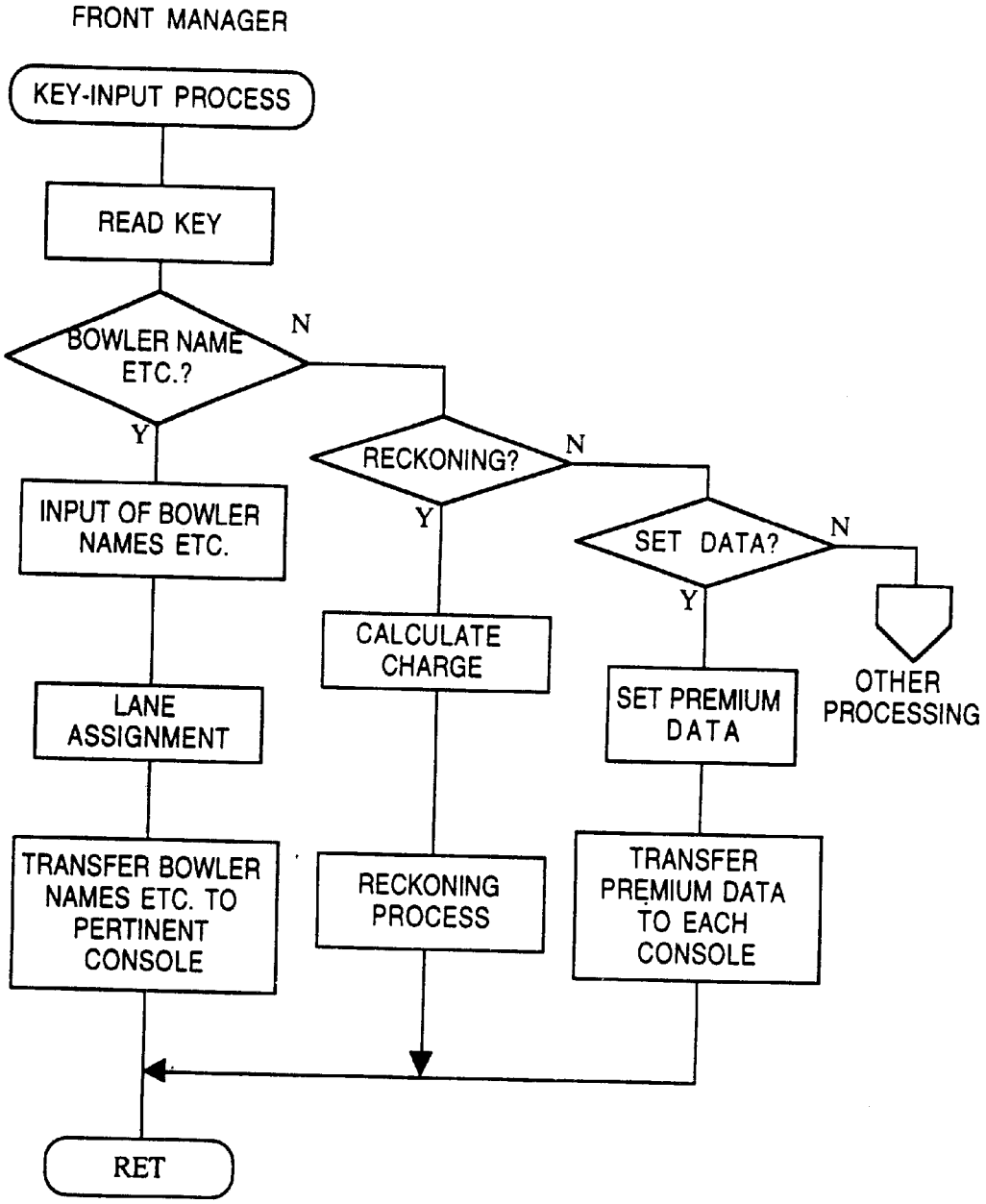
FIG. 13 is a flow chart showing the contents of key-input process by the front manager.

FIG. 13 is a flow chart showing the contents of key-input process by the front manager. First, upon some key operation, the front manager reads this key operation; for example, if some bowler names are inputted, the front-manager reads them and transfers data of the bowler names and the like to a console of an empty lane. Also, if the account key is operated, the front manager calculates the charge at the pertinent lane, executing the accounting process. Further, if a key operation for setting premium data, which sets what points are added in what score state or pin state, is operated, then the data setting is executed and transferred to each console. As a result, premium data is set at each console.

Figure 14:
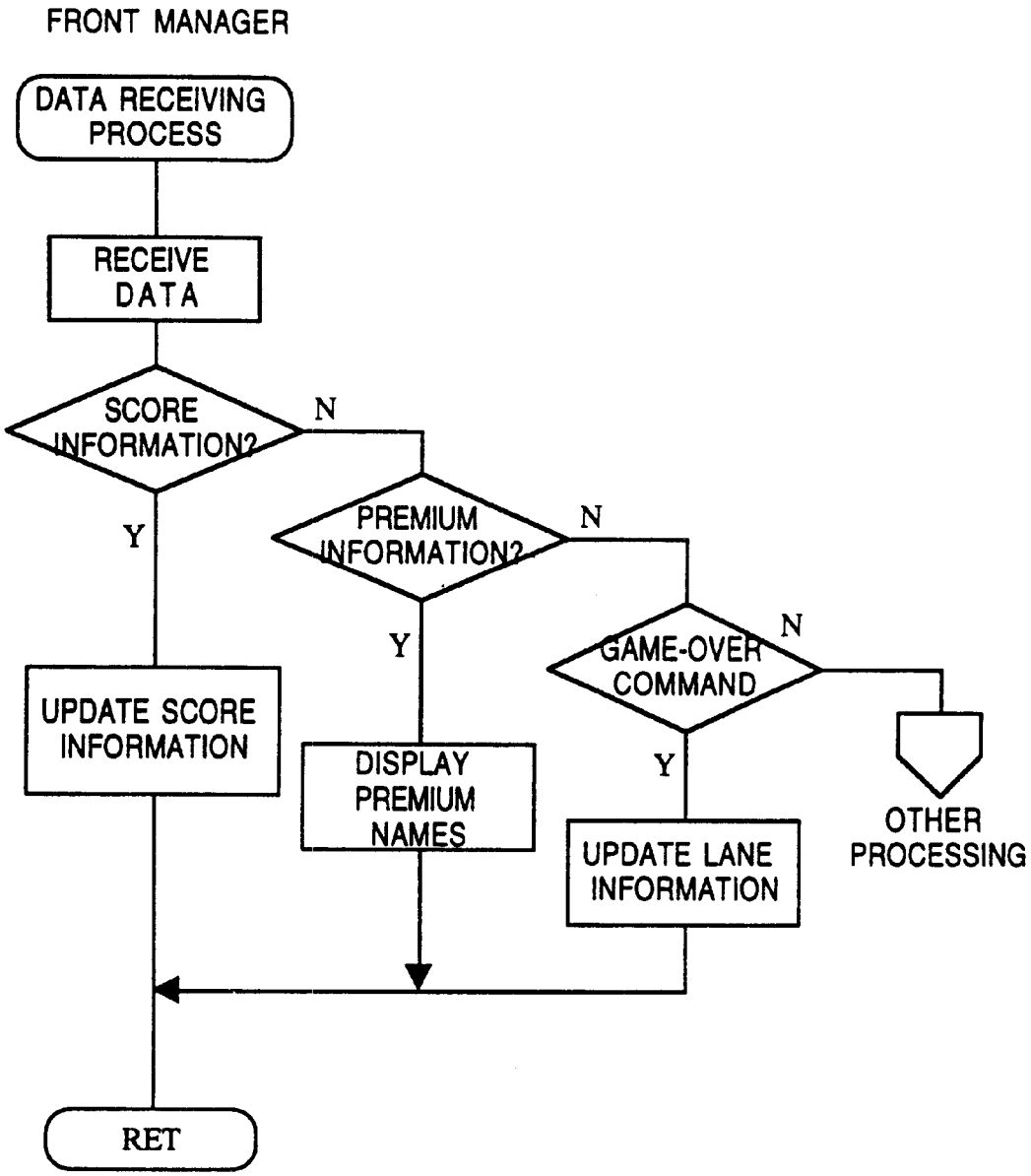
FIG. 14 is a flow chart showing the procedure of data reception process by the front manager.

FIG. 14 is a flow chart showing the contents of the processing in accompaniment to data reception by the front manager. First, upon receiving score information from a console, the front manager updates the score information in the pertinent lane. Upon receiving gift information, the front manager displays it in the selected gift display field in the pertinent lane. Further, upon receiving a game over command, the front manager regards the pertinent lane as having become an empty lane, updating the lane information.

Figure 38A:
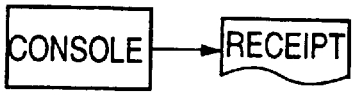
FIG. 38 is block diagrams showing arrangement examples of the individual Claims.
Figure 38B:
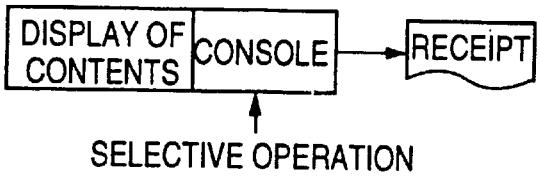
Figure 38C:
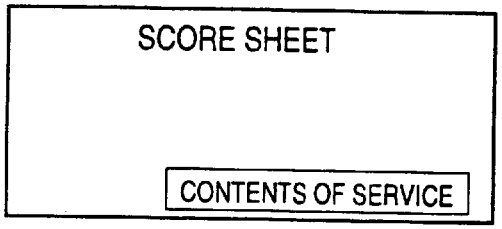
Figure 38D:
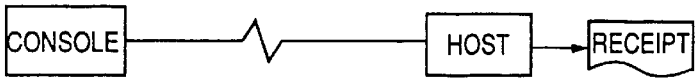
Figure 38E:
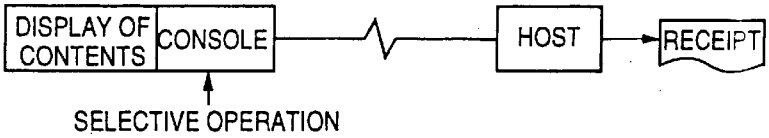
Figure 38F:
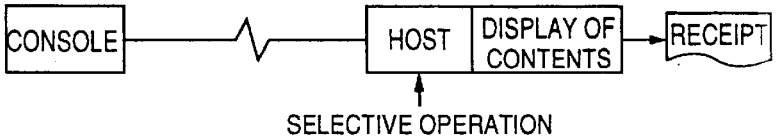

As described above, the first embodiment has showed an example in which score sheets are printed on the console side, where the designations of gifts for the customers to receive are printed. Otherwise, it is also possible that a score sheet is printed on the front manager side based on the score information received from the console, where the designations of gifts selected by the customers are printed on the score sheet. Also, the first embodiment has shown an example in which the gift selection screen is displayed on the console side for the customer to make a selection. However, since the score information to be transferred from the console to the front manager includes data of points, it is also possible that the front manager displays the names of selectable gifts responsive to the points, where the gift selection operation is executed on the front manager side as shown in FIG. 38F and the service contents are printed out together with the score as shown in FIG. 38C.

Next, the arrangements of an automatic bowling scoring apparatus, as well as a service information output method for a bowling alley, which are second embodiments of the present invention are described with reference to FIGS. 15 to 16.

Figure 15A:
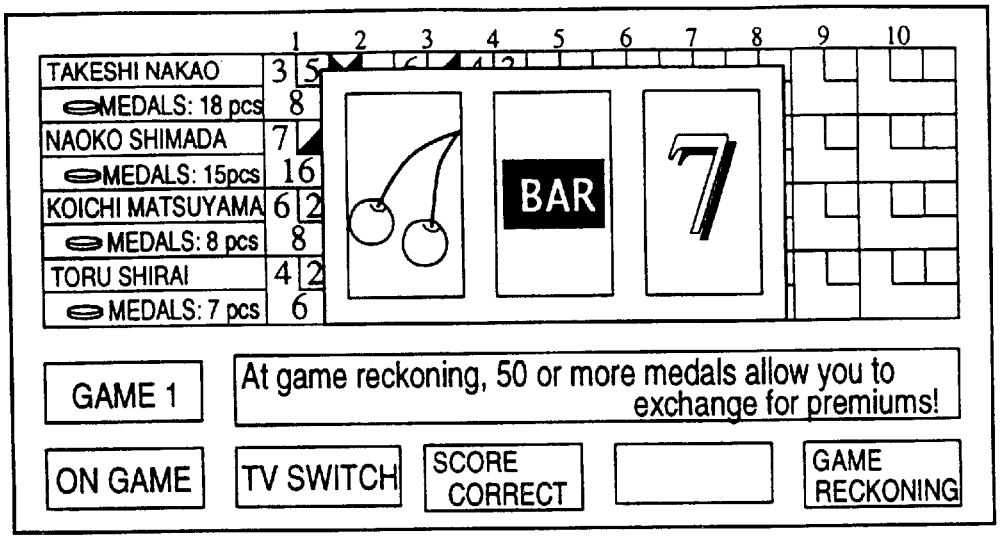
FIG. 15 is a view showing a display example on the console according to the second embodiment.
Figure 15B:
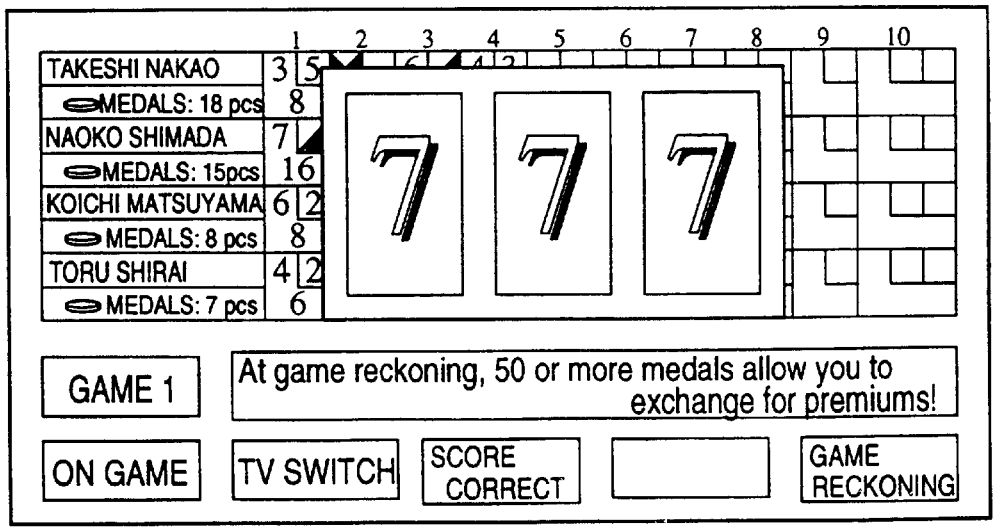

The first embodiment has been so arranged that points other than the score of the bowling game are determined in response to the score state or pin state of the bowling game. By contrast, in this second embodiment, another pastime is displayed in response to the score state or pin state of the bowling game on the display section where the score of the bowling game is displayed, as shown in FIG. 15. In this example, a slot machine is displayed when a bowl has resulted in a strike, as an example. In the case of FIG. 15A, no points are added. However, specified points are added when the contents of the slot machine display come to a predetermined specific state as shown in FIG. 15B. Then, in the state shown in FIG. 15B, the display moves to such a medal discharge display as shown in FIGS. 5B and 5C.

Figure 16:
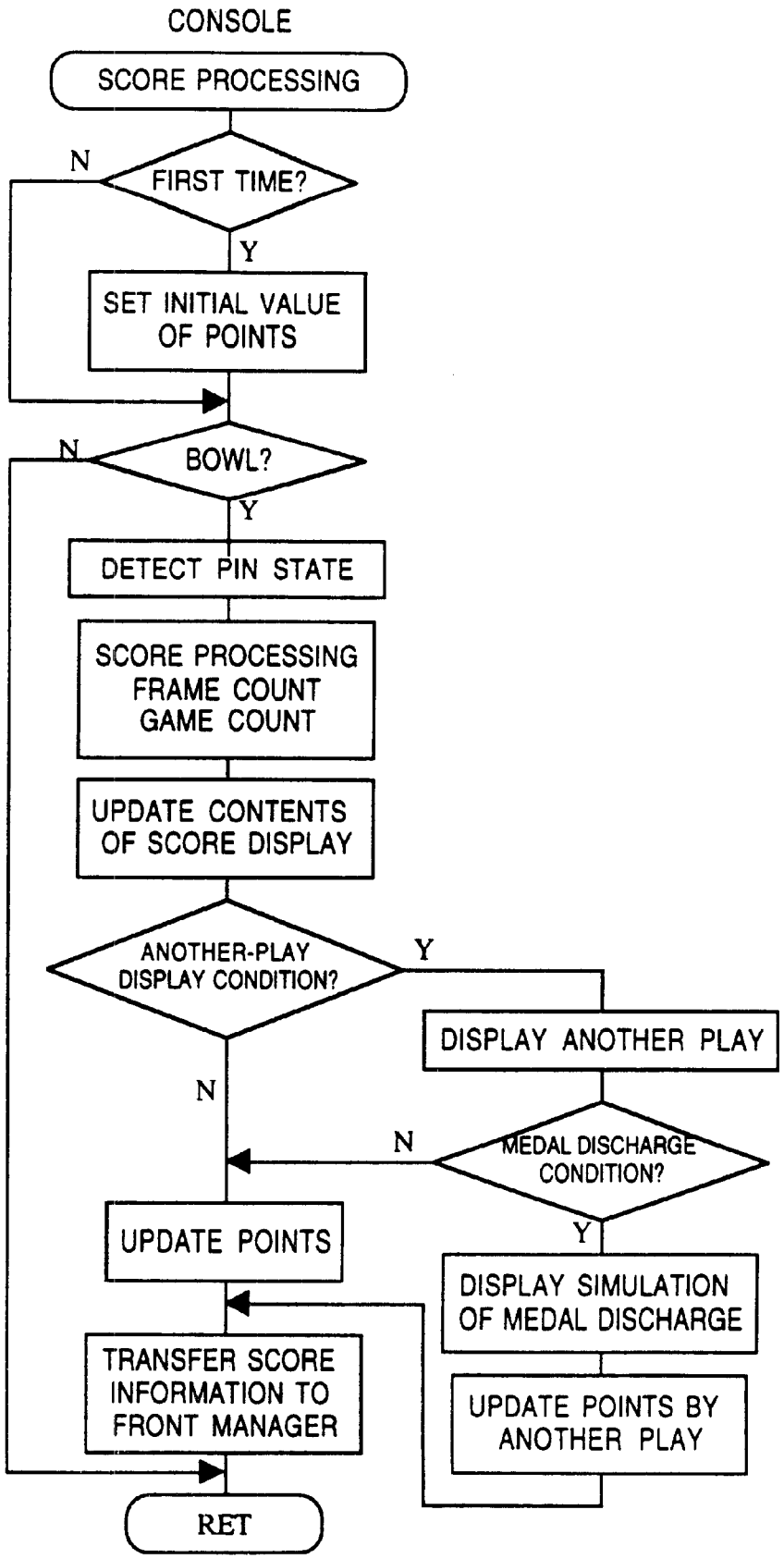
FIG. 16 is a flow chart showing the procedure of score processing by the console.

FIG. 16 is a flow chart showing the procedure of score processing by the console. First, 10 points as an example are set as the initial points for each bowler. Upon a bowl, the resulting pin state is detected, and the scoring process, the counting of frames, or the counting of games is executed based on the pin-state detection result. Subsequently, the contents of the score display are updated responsively. Then, when the current score state or in state has come to a predetermined state (which may be one selected from those described in the first embodiment, as it is) under a condition of score-state determination (e.g., upon each bowl, at an end of one-frame bowls, or at an end of 10 frames), the slot machine is displayed as another pastime. Thus, upon a specific display state as shown in FIG. 15B, a specified point is added responsively, and a simulative display of discharging medals in the corresponding number is executed while the points are updated. During this process, a medal-discharge effective sound is produced in accompaniment to the simulative display of medal discharge. If the another game displayed has not come to the specific state, 1 is subtracted from the point of the pertinent bowler. After that, score information including the point is transferred to the front manager.

In addition, if the rules that lack of bowling skill is reflected on the increase in points are used in combination as described before, the another game will be displayed more frequently for bowlers who are poor at the bowling skill, thus being more attractive for those bowlers.

In the second embodiment, it has been arranged that in response to the score state or pin state of the bowling game, another game is displayed in the display section where the score of the bowling game is displayed. Otherwise, it is also possible that another game is displayed at a specified probability during the bowling game in the display section where the score of the bowling game is displayed. For example, in the processing of FIG. 16, a random number of a specified random-number string is produced as the "another game display condition", and if the value of the random number falls within a specified range, the another game is displayed, where the probability at which another game is displayed may be determined by the specified range. In more detail, if a uniform random number within a range of, for example, 0.0 to 1.0 is produced and the resulting random number is lower than a specified value, then another game may be displayed. Also, the probability at which the display of another game (slot machine in the above example) comes to a specified state may also be controlled by producing a random number, as in the determination of the another game display condition.

Next, the arrangement of a bowling alley management system, which is a third embodiment of the present invention, is described with reference to FIGS. 17 to 23.

Figure 17:
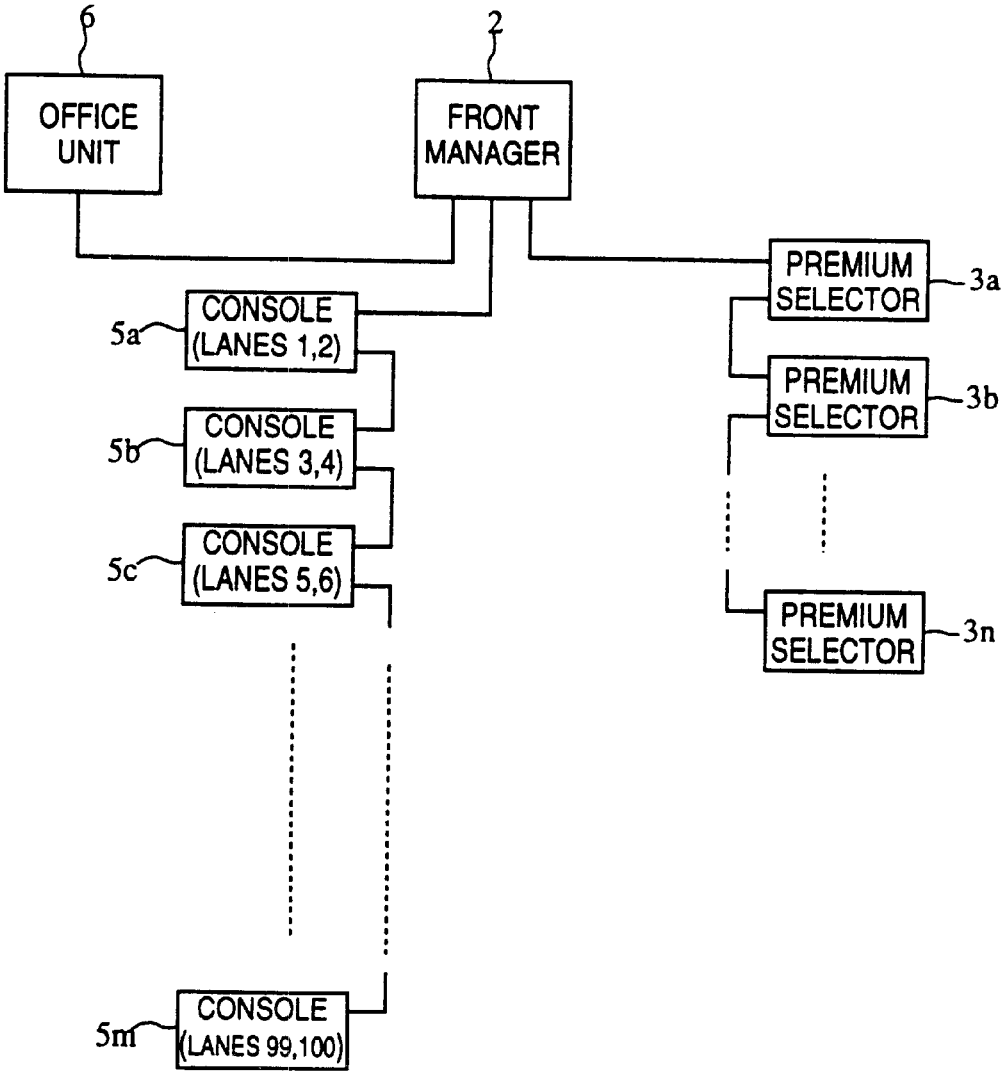
FIG. 17 is a block diagram showing the overall arrangement of a bowling alley management system according to the third embodiment.

FIG. 17 is a block diagram showing the overall arrangement of the bowling alley management system. In this case, the bowling alley management system is made up by connecting consoles 5*a*, 5*b*, . . . , 5*m* provided for every two lanes, gift selectors 3*a*, 3*b*, . . . , 3*n*, a front manager 2, and an office unit 6 provided in the office, with one another via a local area network.

Figure 18:
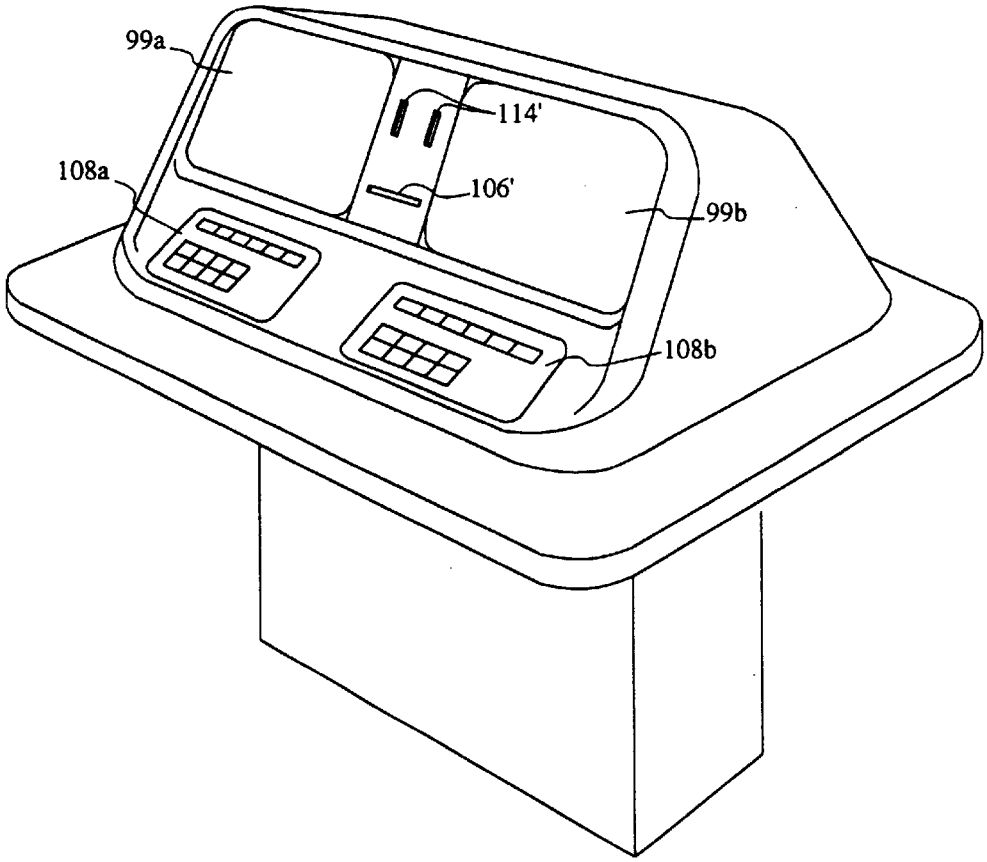
FIG. 18 is a perspective view of the appearance of the console.

FIG. 18 is an appearance perspective view showing the arrangement of the console. Referring to FIG. 18, numerals 99*a*, 99*b* each denote a CRT for displaying the score as well as points other than the score and the contents of another game, and numerals 108*a*, 108*b* each denote a keyboard used for the correction of the names of bowlers, the correction of the score, and the like. Numeral 114' denotes a card inlet, which allows a card owned by each bowler to be inserted therethrough so that data write/read is executed on the card. Reference numeral 106' denotes a paper outlet of the printer for outputting score sheets and the like, where the printer is shared by right and left lanes.

Figure 19:
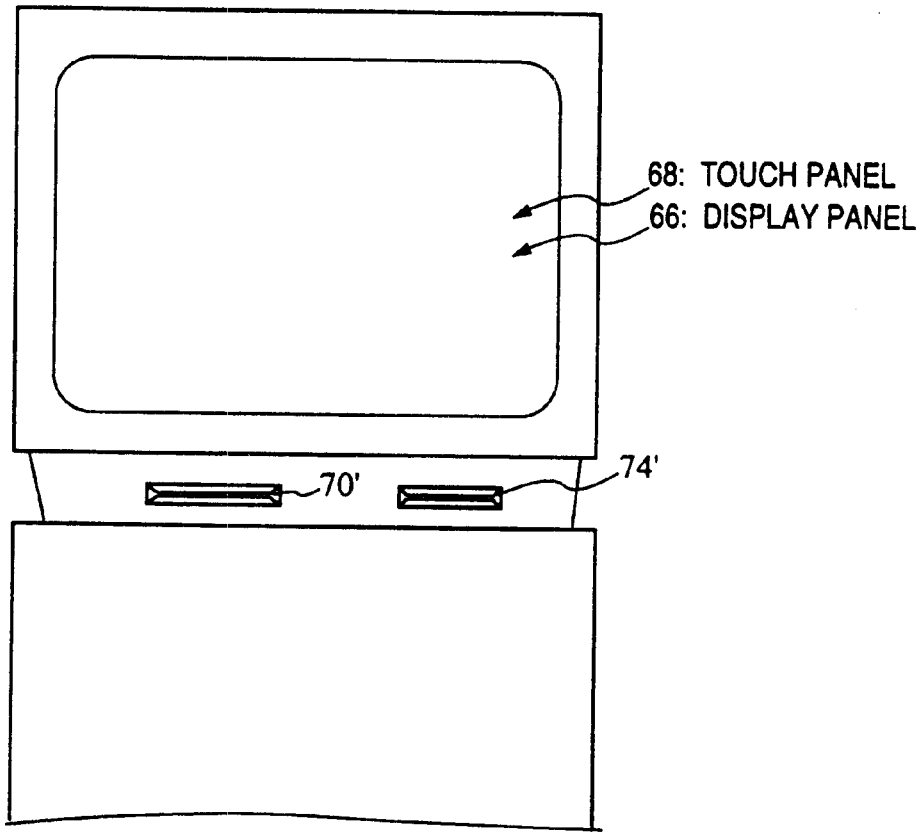
FIG. 19 is a front view of the appearance of a gift selector.

FIG. 19 is an appearance front view showing the arrangement of the gift selector. Referring to FIG. 19, reference numeral 66 denotes a display panel for listing and displaying the designations of the gifts to be selected and the like, and numeral 68 denotes a touch panel for detecting any touch position on the display panel. Reference numeral 74, denotes a card inlet and 70' denotes an outlet of the printer for discharging a gift-exchange use receipt.

Figure 20:
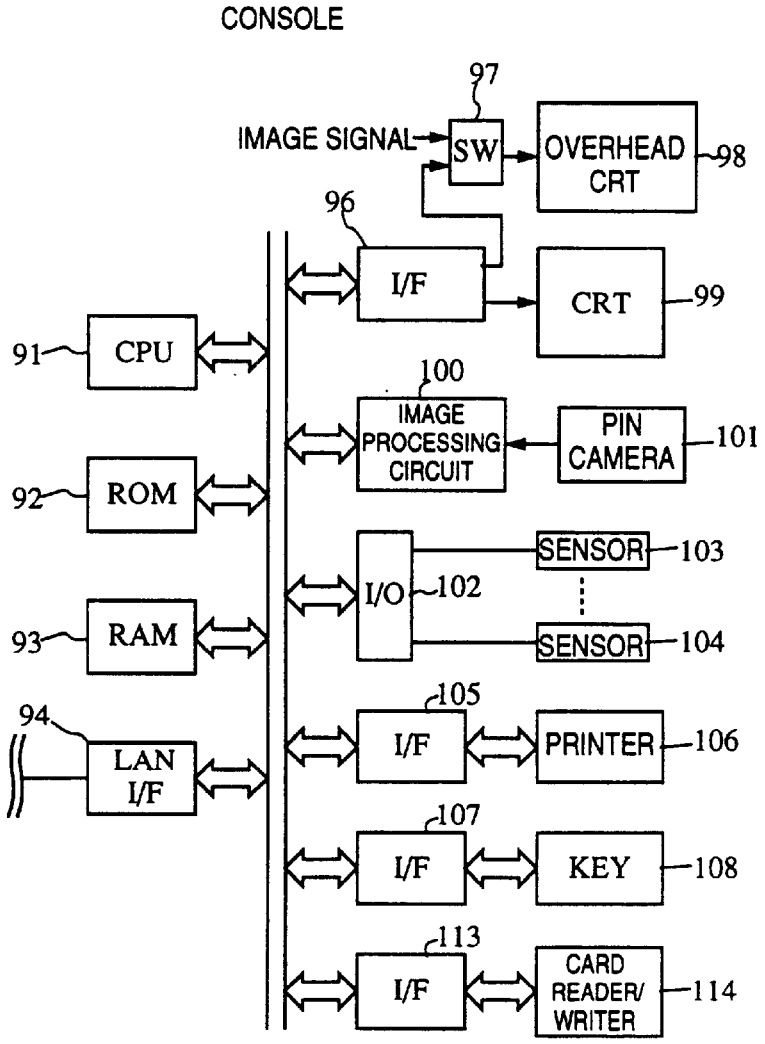
FIG. 20 is a block diagram showing the arrangement of the console.

FIG. 20 is a block diagram of part of one console out of the consoles 5*a* to 5*m* shown in FIG. 17 that executes the scoring process for one lane. The difference from the example shown in FIG. 3 in the first embodiment is that a card reader/writer and an interface 113 therefor are provided. The rest of the arrangement is the same as in the first embodiment.

Figure 21:
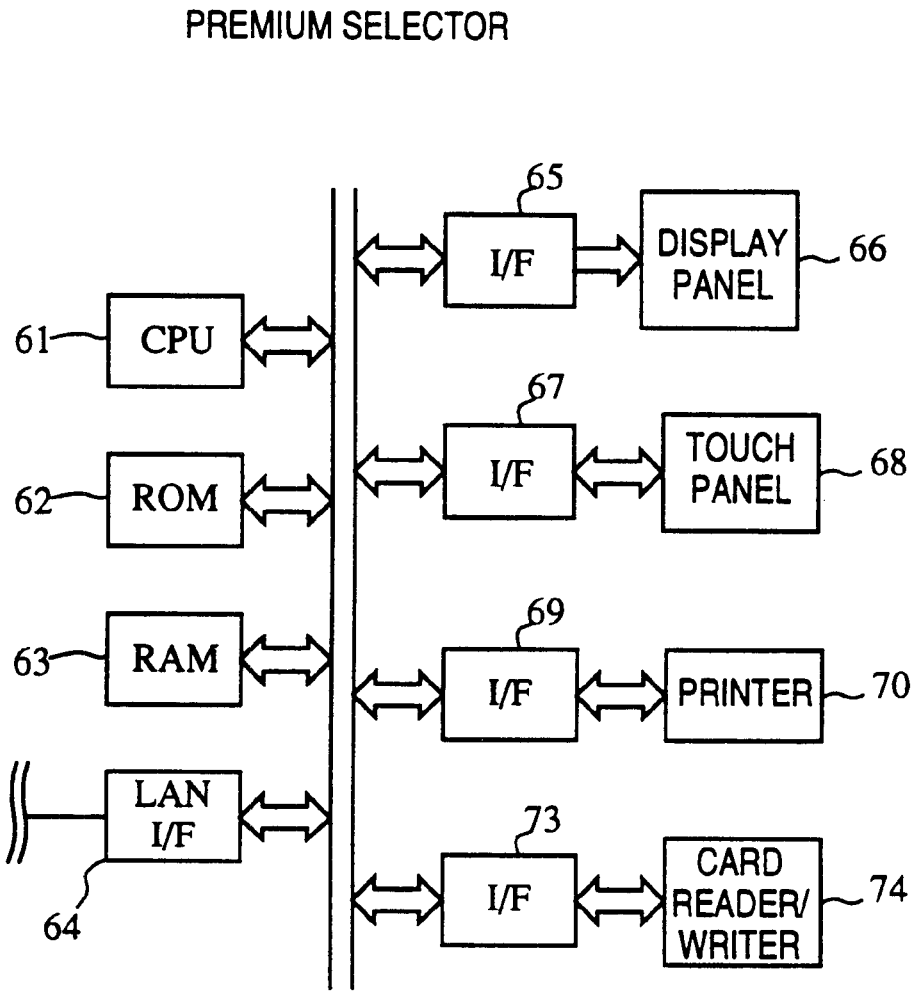
FIG. 21 is a block diagram showing the arrangement of the gift selector.

FIG. 21 is a block diagram showing the arrangement of one of the gift selectors 3*a*, 3*b*, . . . , 3*n* shown in FIG. 17. Referring to FIG. 21, a CPU 61 executes programs previously written in a ROM 62. A RAM 63 is used as various types of working areas during the execution of the programs. A LAN interface 64 is a circuit for interfacing with a local area network, and executes the transfer control of various data in conjunction with the front manager or the like via the local area network. A display panel 66, which lists on the display the designations of exchangeable gifts, where the CPU 61 executes the display via an interface 65. The touch panel 68, which is located in the front of the display panel 66, is used for the input operation of a gift selection. The CPU 61 reads a touch position via an interface 67. A printer 70 prints out a gift-exchange use receipt, where the CPU 61 gives print data via an interface 69. A card reader/writer 74 performs data read/write on a card inserted by a customer, while the CPU 61 reads and updates point data via an interface 73.

Figure 22:
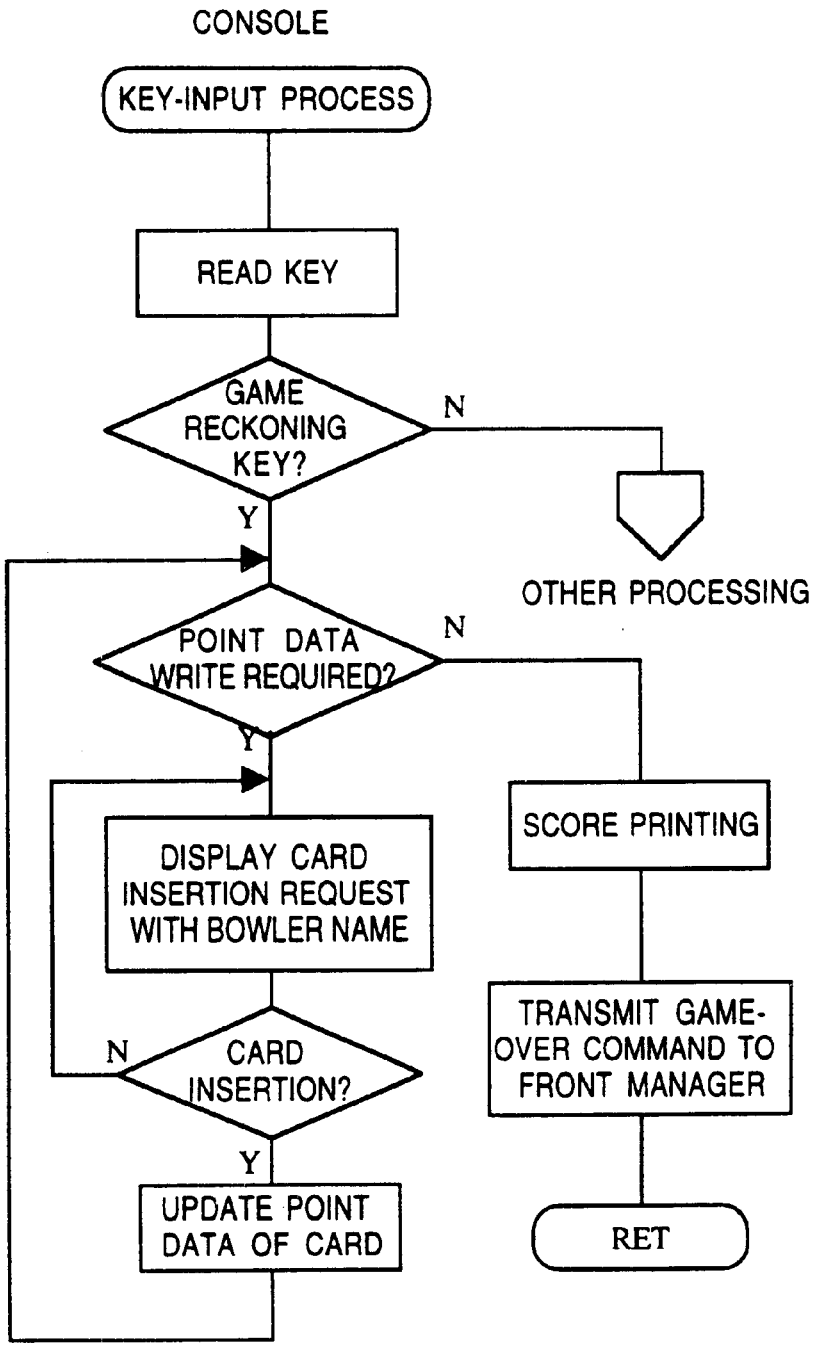
FIG. 22 is a flow chart showing the procedure of key-input process by the console.

FIG. 22 is a flow chart showing the procedure of key input process by the console. First, upon some key operation, the console reads it; for example, upon an operation of the game-account key, if some new points have been acquired this time, the console displays, on its CRT, a request of card insertion together with the name of the bowler in order to add the new points to the points stored in the card, awaiting the insertion of the card. With the card inserted, the console updates the point data on the card. This process is iteratively executed on all the bowlers that the updating of point data should be done. Then, the score sheet is printed, and the game-over command is transmitted to the front manager.

Figure 23:
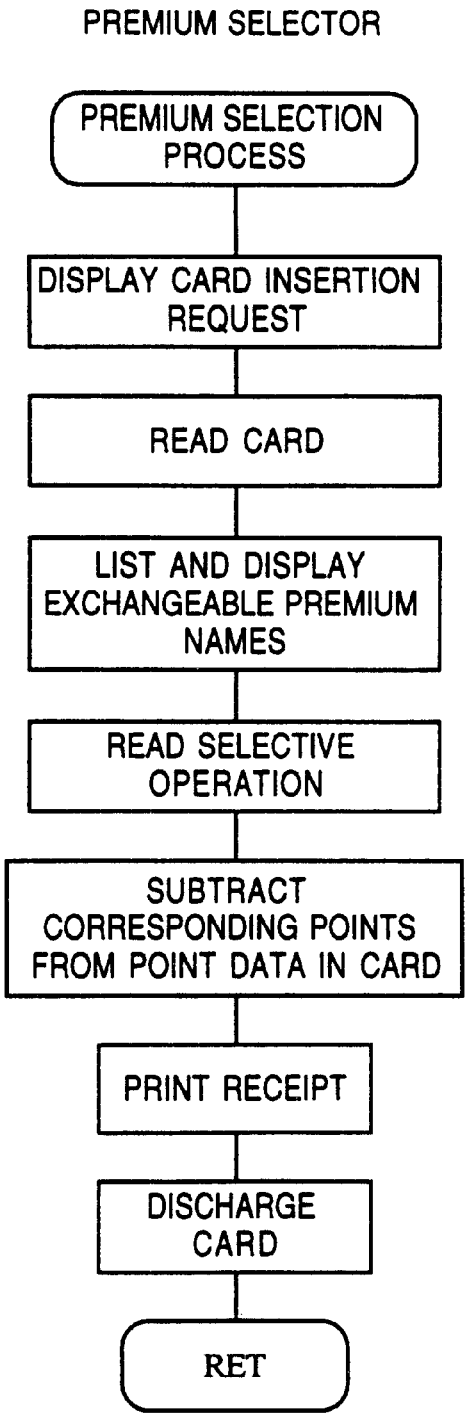
FIG. 23 is a flow chart showing the procedure of processing by the gift selector.

FIG. 23 is a flow chart showing the procedure of processing by the gift selector. First, the gift selector displays a guide for card insertion, awaiting the insertion of the card. With the card inserted, the designations of gifts that are exchangeable in response to the points already recorded on the card are displayed in a list as shown in FIG. 7A or 8A. However, the display at this time is one having no such indications of key functions as are presented in FIG. 7A or 8A. Then, upon a touch on any one of the gift name fields out of the selectable gifts, the gift selector subtracts points corresponding to the selected gift from the point data stored in the card. As to an example of the correlation between points and gifts as shown in FIG. 7A, when a juice coupon is selected, 50 is subtracted from the point data in the card. In the case of 53 points as an example, the point data is updated to 3. Thereafter, a gift-exchange use receipt as a juice coupon is printed out, and the card is discharged.

Figure 39A:
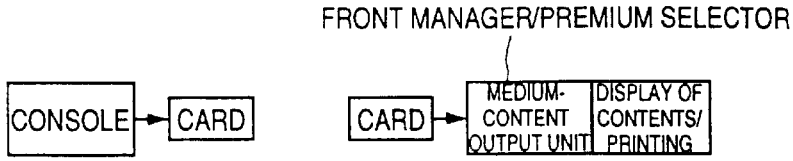
FIG. 39 is block diagrams showing arrangement examples of the individual Claims.
Figure 39B:
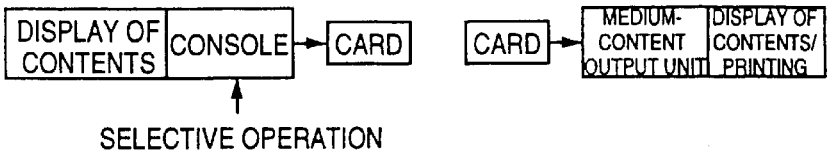
Figure 39C:
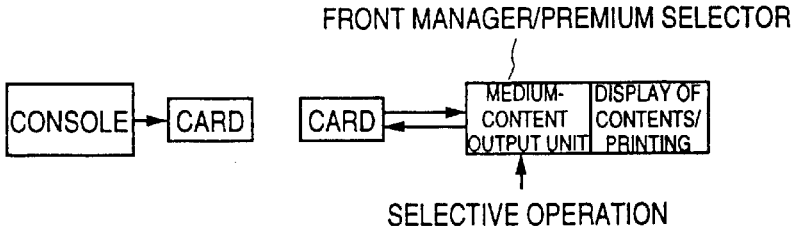
Figure 39D:
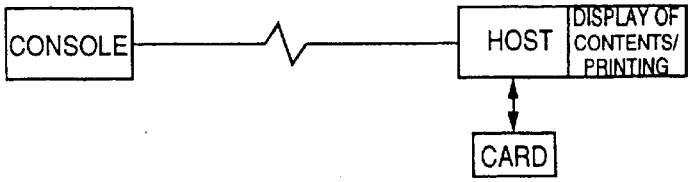

In the above third embodiment, the card in which point data has been written is read by the gift selector, where the customer may effect a gift selection. However, as shown in FIG. 39C, it is also possible that the front manager reads the card, displays or prints out its points, where service such as gifts is offered to the customer in response to the points. In this case, points corresponding to the service offered may be subtracted. from the point data in the card by the front manager. Furthermore, in the third embodiment, points or the like are written into the service medium such as a card on the console side. otherwise, it is also possible, as shown in FIG. 39D, that point data is transferred from the console to the front manager via the local area network, so that the point data is written into the service medium such as a card on the front manager side.

Next, the arrangement of a bowling alley management system, which is a fourth embodiment of the present invention, is described with reference to FIGS. 24 to 25.

Figure 24:
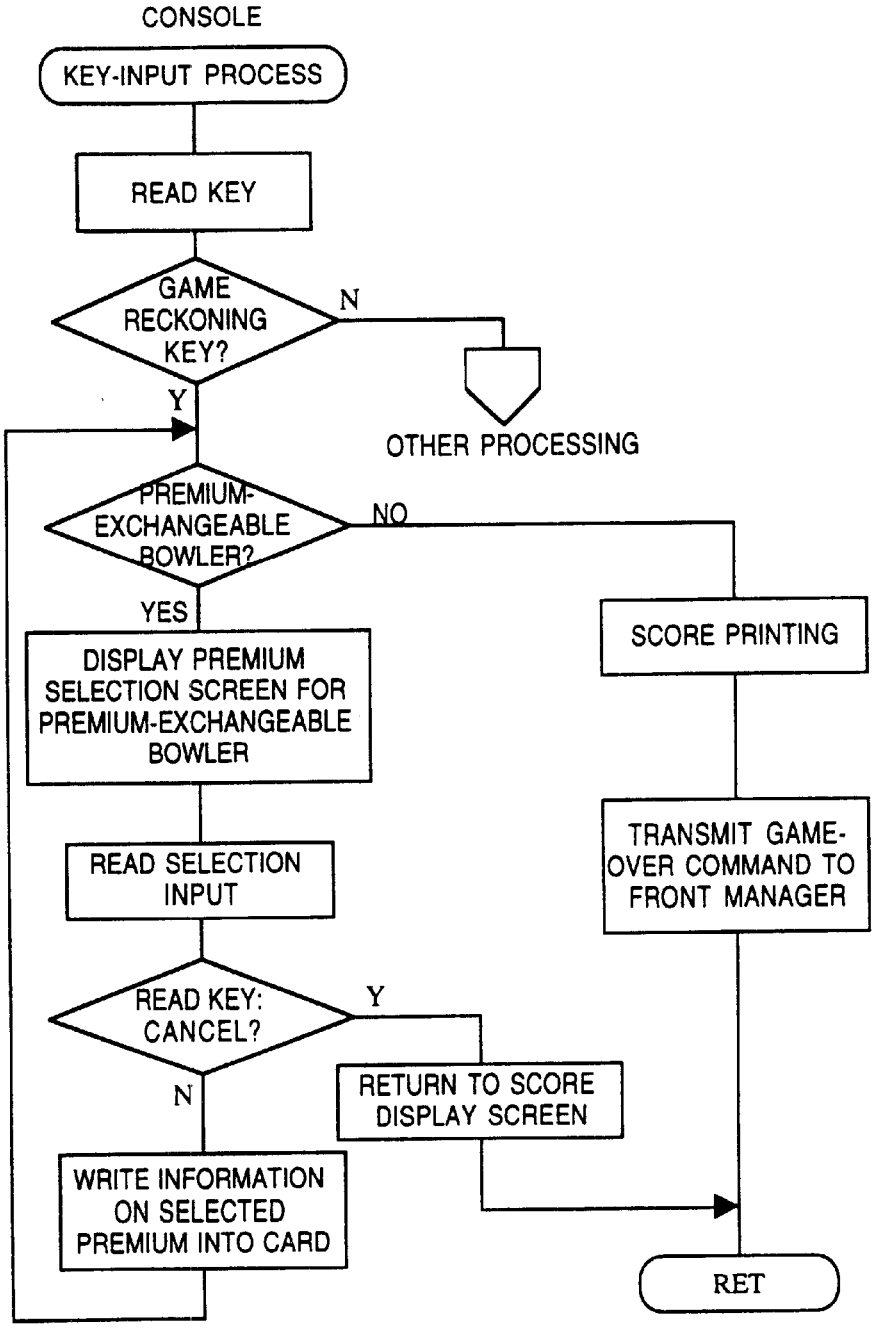
FIG. 24 is a flow chart'showing the procedure of key-input process by the console according to the fourth embodiment.

FIG. 24 is a flow chart showing the procedure of key-input process by the console. First, upon some key operation, the console reads it; for example, upon an operation of the game-account key, if any bowler has acquired gift-exchangeable points, then the console displays a gift selection screen for the bowler as shown in FIG. 7A, awaiting a selection input. With the gift selection input effected, the console writes the information on the selected gift into the card. This process is iteratively executed on all the bowlers that have acquired gift-exchangeable points. Then, the score sheet is printed, and the game-over command is transmitted to the front manager. In addition, when the cancel key is operated on the gift selection screen, the console will return to the score display screen.

Figure 25:
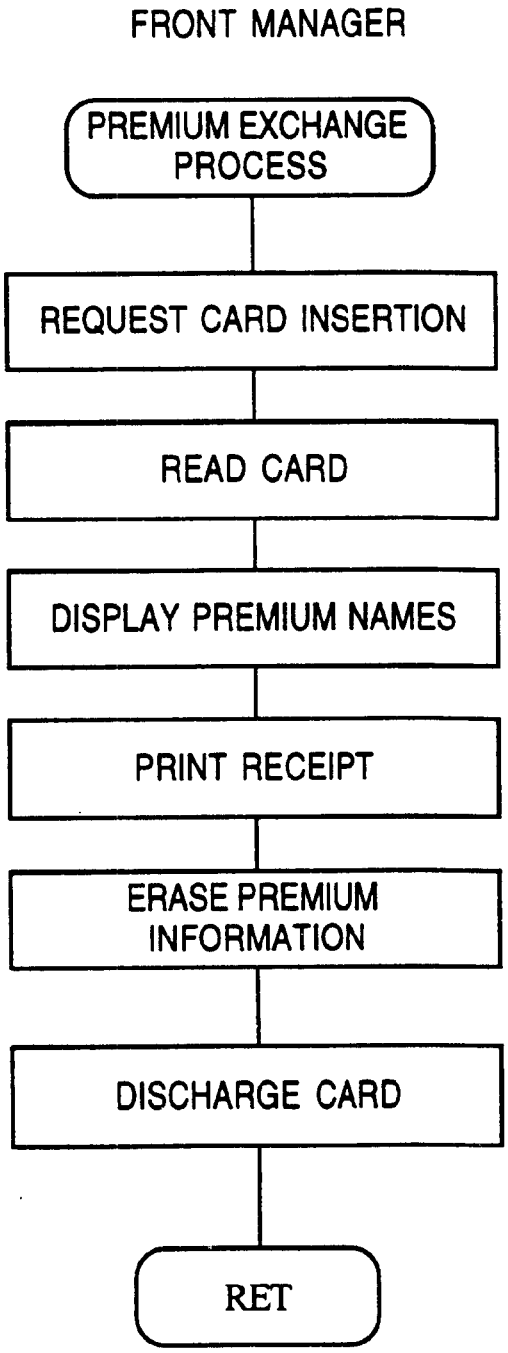
FIG. 25 is a flow chart showing the procedure of gift-exchange process by the front manager according to the fourth embodiment.

FIG. 25 is a flow chart showing the procedure of gift-exchange process by the front manager. The front manager first displays a guide for requesting card insertion, reads data of the inserted card, displays the name of a gift to be offered to the customer based on the gift information contained in the data, and prints out the gift name on the receipt. Thereafter, the front clerk. will hand over the gift to the customer, where for a one-game discount coupon or a one-game free coupon, the receipt itself printed out here may be used as such a coupon. Then, the gift information is erased from within the card, and the card is discharged.

Next, the arrangements of an automatic bowling scoring apparatus, as well as a service information output method for a bowling alley, which are fifth embodiments of the present invention are described with reference to FIGS. 26 to 28.

Figure 26A:
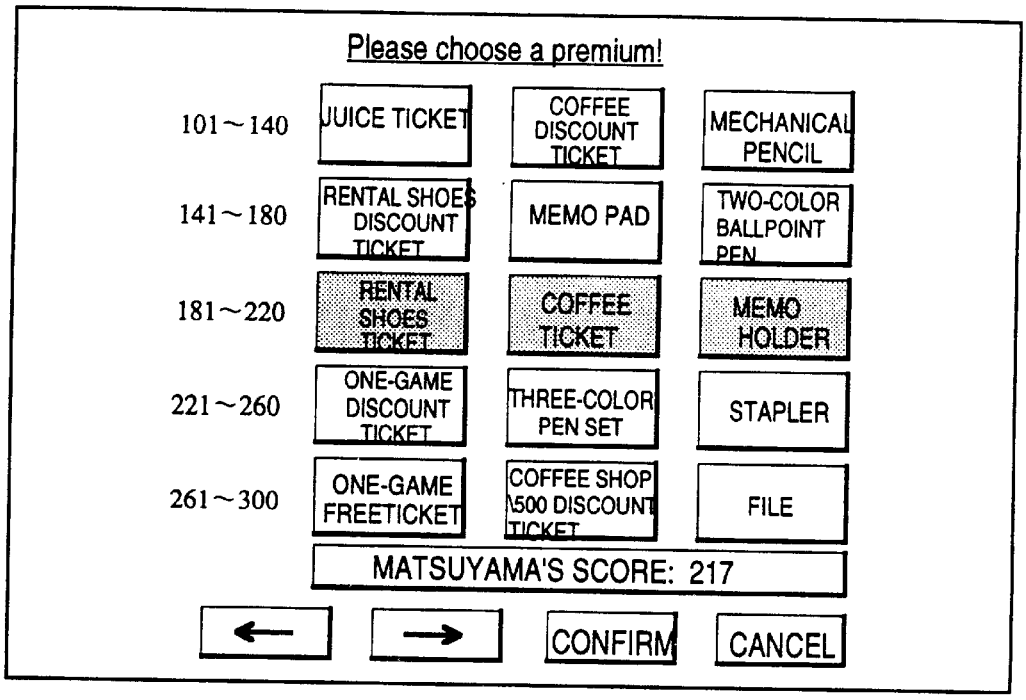
FIG. 26 is a view showing a display example on the console as well as a printout example of the score sheet according to the fifth embodiment.

In the embodiments shown hereinabove, it has been arranged that points other than the score of the bowling game are determined in response to the score state or pin state of the bowling game, or that a game other than the bowling game is displayed, where points other than the score of the bowling game are determined, so that service is offered to customers in response to these points. By contrast, in the fifth embodiment, without determining such points, service is offered to customers in response to the score or after-bowl pin state of the bowling game. FIG. 26A shows a display example of the gift selection screen in the console, and FIG. 26B shows a printout example of the score sheet in the console. As in the first embodiment, upon an operation of the game-account function key, the screen turns to the display of a gift selection screen as shown in FIG. 26A. This gift selection screen is effected for each of the bowlers whose score of the bowling game is not less than 101. In the example shown in the figure, since a bowler, Koichi Matsuyama, has shown a, score of 217, the designations of gifts exchangeable with the score in the range of 181 to 220 are displayed in a color different from that of the other gifts. In this state, operating any of function keys shown by arrows as functional indication in the lower part of the screen causes the cursor display position (a position displayed in a color different from that of the other gifts) to be focused on one, where the cursor display position moves each time any of the function keys corresponding to the arrow keys is operated. Then, operating a function key serving as the confirmation key effectuates a selection of a gift shown by the cursor. Once the gift selection screen shown in FIG. 26A has been displayed for every bowler having a score of not less than 101 and every bowler has selected a gift, the score sheet is printed out together with the gifts selected by the bowlers as shown in FIG. 26B.

Figure 27A:
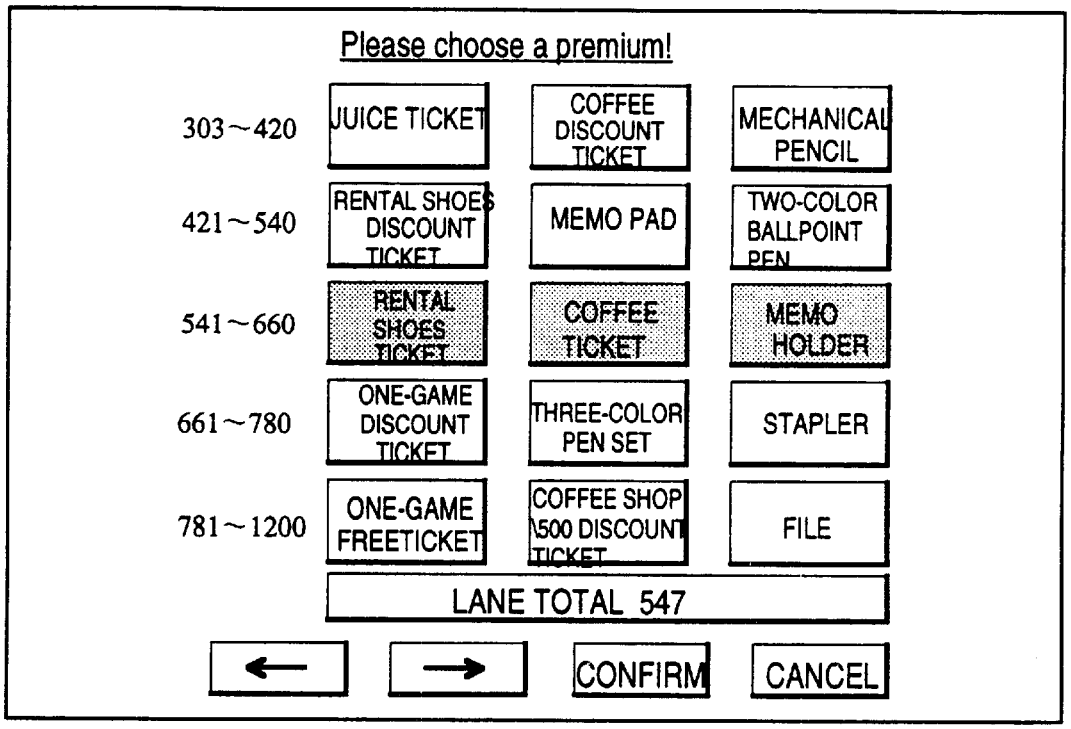
FIG. 27 is a view showing a display example on the console as well as a printout example of the score sheet according to the fifth embodiment.

FIG. 27A shows a display example of the gift selection screen in the console, and FIG. 27B shows a printout example of another score sheet in the console. Unlike the example shown in FIG. 26, in this case, the gift selection is effected in response to the sum of the score points of the bowlers attained in a pertinent lane (i.e., lane total). That is, since the total of the score points of the four bowlers played in the lane is 547 as shown in FIG. 27, the designations of gifts exchangeable with the score of 541 to 660 are displayed in a color different from that of the other gifts as shown in FIG. 27A. In this state, if the cursor is moved to, for example, the position of coffee coupon by operating any of the function keys serving for moving the cursor as in the foregoing case, followed by operating a function key serving as the confirmation key, then the gift name is printed on the score sheet as shown in FIG. 27B.

Figure 28:
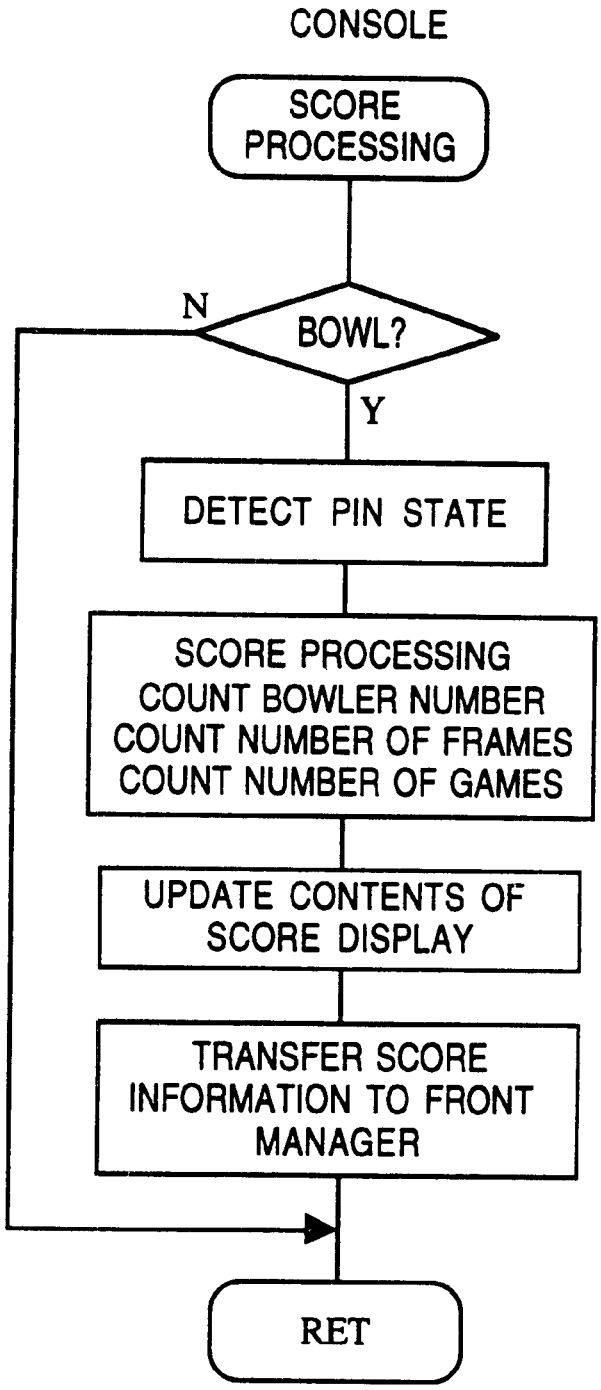
FIG. 28 is a flow chart showing the procedure of score processing by the console according to the fifth embodiment.

FIG. 28 is a flow chart showing the contents of score processing by the console. Upon a bowl, the console detects the pin state after the bowl, and executes the scoring process based on the detection result. This scoring process includes counting the bowler number, counting the frame number, or counting the game number in response to the bowl at that time. Subsequently, the console updates the contents of the score display responsively, and transfers score information to the front manager. This score information corresponds to the score counting result and the pin-state detection result according to the present invention.

The console executes the gift selecting process and prints out a score sheet containing designations of gifts, as in the first and second embodiments.

In the above fifth embodiment, the score sheet is printed on the console side, where designations of gifts to be received by customers are printed together. However, it is also possible, as shown in FIGS. 38D and 38E, that the score sheet is printed on the front manager side based on score information received from the console, and that the designation of a gift selected by the customer is printed on the score sheet. Also, the fifth embodiment has shown an example in which the gift selection screen is displayed on the console side for the customer to make a selection. However, it is also possible that the designations of exchangeable gifts are displayed on the front manager side based on the score information received from the console, and that the operation of gift selection is executed on the front manager side as shown in FIG. 38F. Further, it is also possible, as shown in FIG. 39A and 39D, that gift information or score information is written into a service medium such as a card on the console side, and that the contents of the information is read and displayed by the front manager.

Next, the arrangements of an automatic bowling scoring apparatus, as well as a service information output method for a bowling alley, which are sixth embodiments of the present invention are described with reference to FIGS. 29 to 32.

In the first embodiment, it has been arranged that points other than the score of the bowling game are determined in response to the score state or pin state of the bowling game, so that service is offered to customers in response to these points. By contrast, in the sixth embodiment, without merely determining the points, a large amount of points will be acquired when the score state or pin state of the bowling game comes to a predetermined specific state, in which arrangement when the current frame or bowl has come to a state having a likelihood that the specific state occurs (hereinafter, referred to as "reach"), the likelihood of the specific state is noticed so that customers will be more excited.

Figure 29:
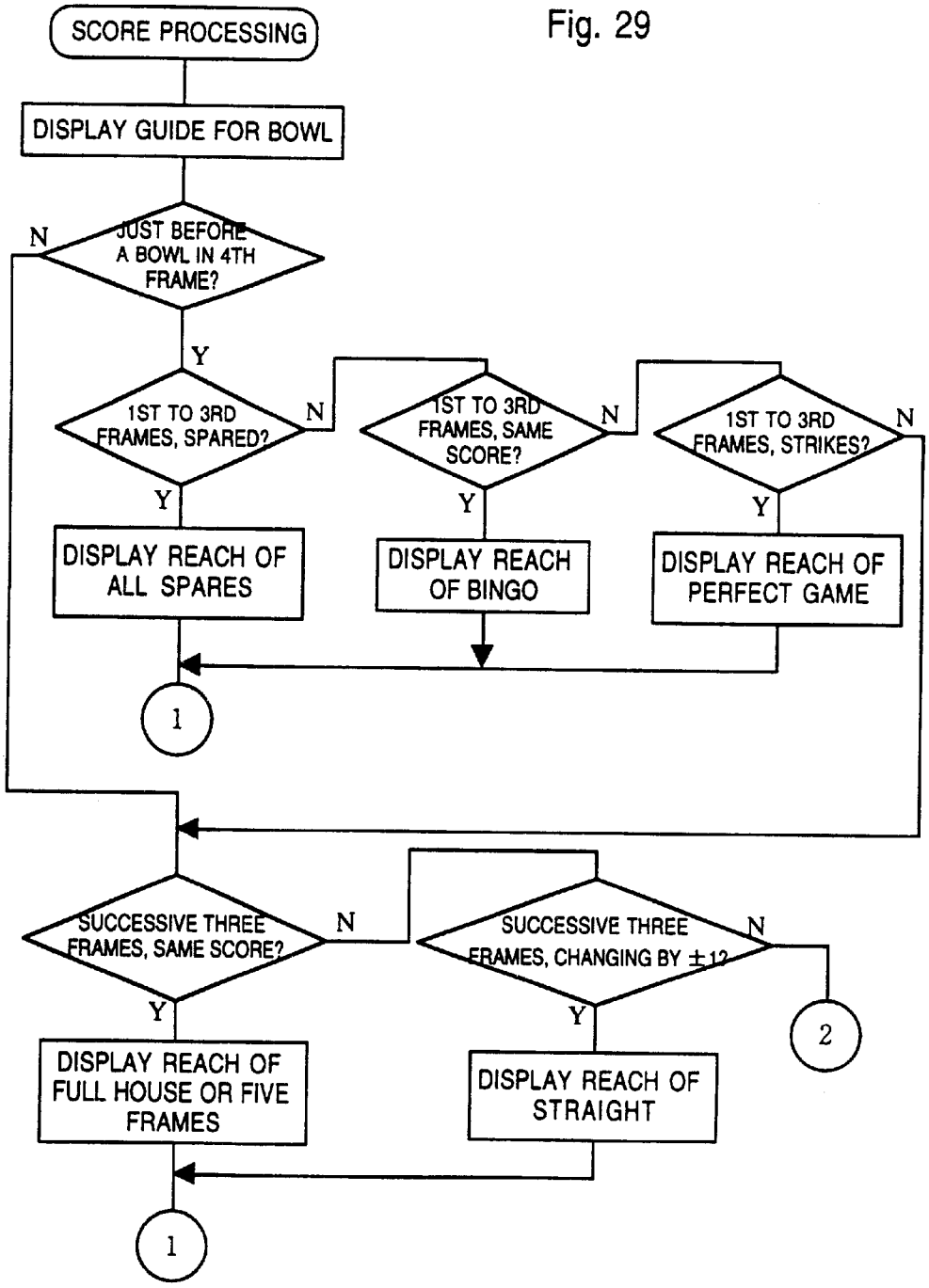
FIG. 29 is a flow chart showing the procedure of score processing by the console according to the sixth embodiment.
Figure 30:
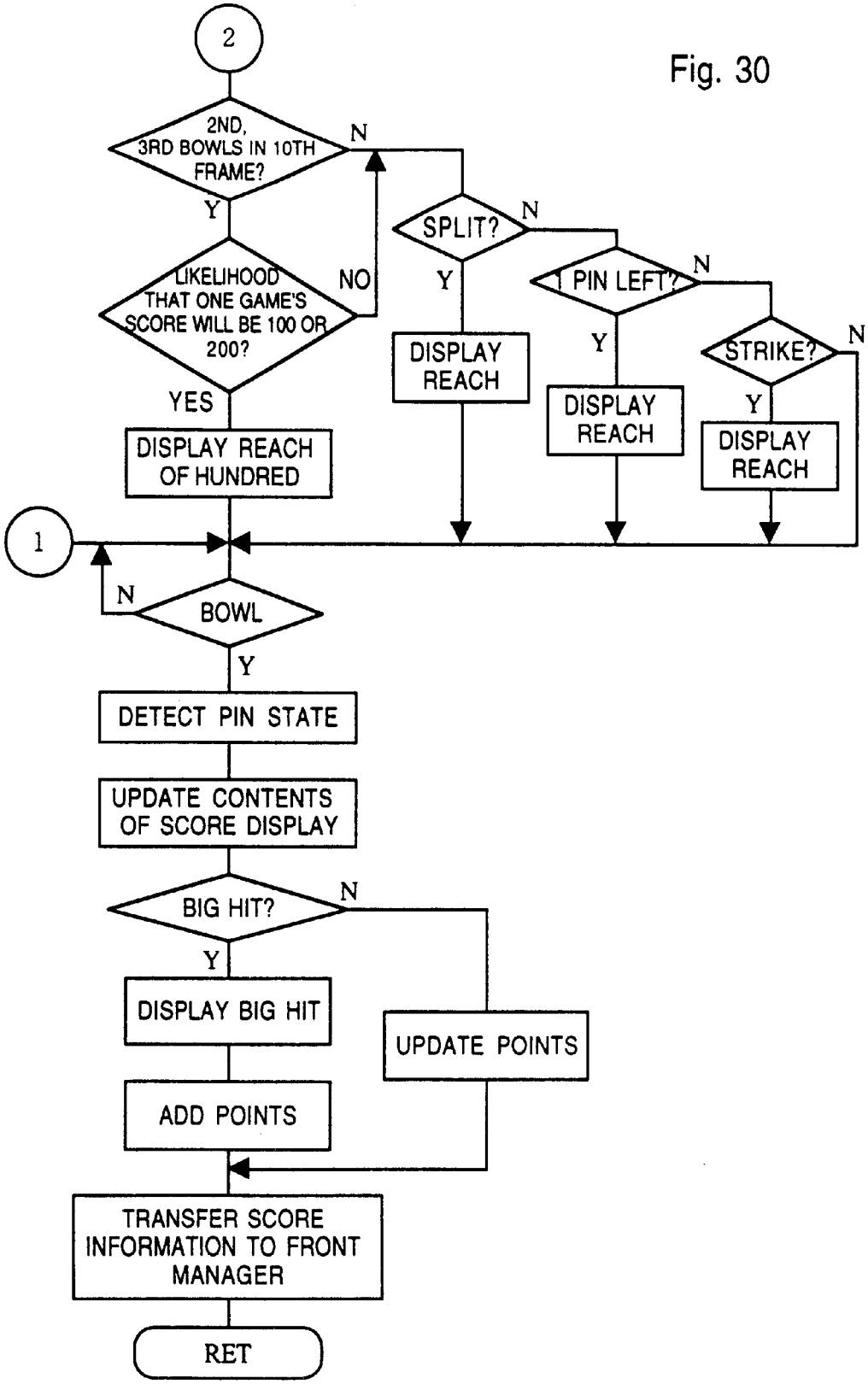
FIG. 30 is a flow chart showing the procedure of score processing by the console according to the sixth embodiment.
Figure 32A:
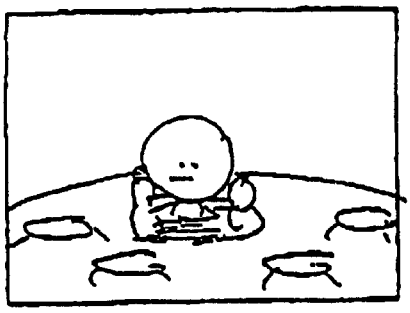
FIG. 32 is a view showing a display example upon formation of a specific state.
Figure 32D:
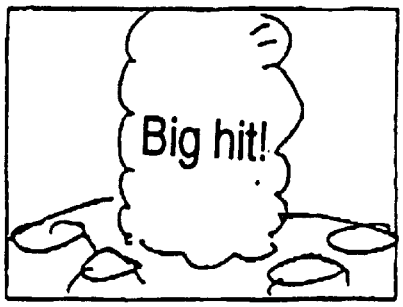
Figure 32B:
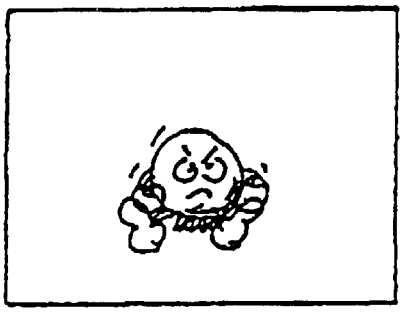
Figure 32E:
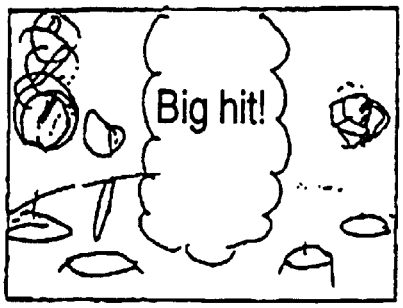
Figure 32C:
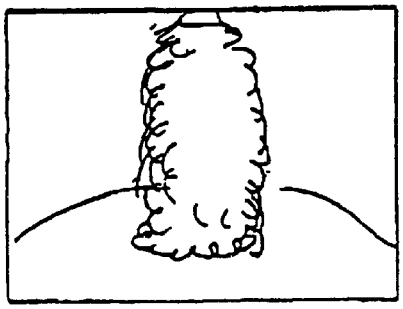
Figure 32F:
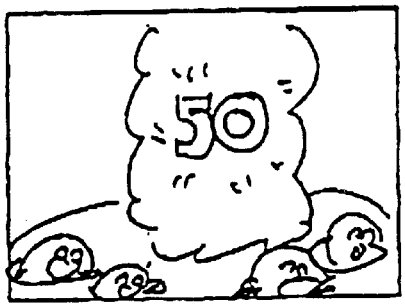

FIGS. 29 and 30 are flow charts showing the contents of score processing by the console.

As shown in FIG. 29, a guide for the bowler now in his or her turn is first displayed. If the bowl is of the fourth frame and if the bowler has performed all spares in the first to third frames, then the notice of a likelihood that "all spares", which means all 10 frames of spares, can hold is displayed in an animation which will be described later. Also, if all the first to third frames have been of the same score, then the notice of a likelihood that a "bingo", which means all 10 frames of the same score, can hold is displayed. Further, if the first to third frames have been all strikes, then the notice of a likelihood that a "perfect game", which means all 10 frames of strikes, can hold is displayed. Further, if the last successive three frames have been of the same score, then the notice of a likelihood that a "full house", which means that the following two frames are of the same score, or a "five frames", which means that successive five frames are of the same score, can hold is displayed. Further, if the successive three frames have been changed in steps of +1 or −1, then the notice of a likelihood that a "straight", which successive five frames are changing in steps of *1, can holds displayed. Still further, in the case where the current bowl is the second or third bowl in the tenth frame, if it is decided that a "hundred", which means that the total score at the end of the game can be 100 or 200, can hold, then it is noticed and displayed. Further, in the case of a split, it is noticed and displayed that sparing this split will lead to a high point responsive to the pattern of the split. Further, in the case where only one pin is left, it is noticed and displayed that sparing the pin will lead to a high point. Further, if the last frame has resulted in a strike, the notice of a likelihood that a "double, "turkey,". . . , "elevens", can hold as well as a point thereby obtained is displayed in response to the number of the successive strikes. Thereafter, when an actual bowl is effected, the console detects the resulting pin state after the bowl, and executes scoring process based on the detection result. In this scoring process, the counting of bowler number, the counting of frame number, or the counting of game number is carried out in response to the bowl at that time. Subsequently, the contents of score display is updated responsively. Then, if a reach state has actually come into a specific state in terms of score state or pin state as a result of this bowl, then a display of big hit is presented in a way as described later, where the corresponding point is added. This point differs depending on the type of reach. For example, even in the aforementioned. case of a spare of a split, a split-having a higher degree of difficulty, such as a 7–10 pin split, would cause a higher point to be added, while a split having a lower degree of difficulty, such as a 4–6 pin split, would cause a relatively lower point to be added. Then, score. information including the point information is transferred to the front manager.

FIG. 31 is a view showing a display example in which the aforementioned reach has occurred. Upon a reach, a display (of a command module and a moon-surface landing module) that attracts the bowler's attention, as shown in FIG. 31A, is first presented after the score display screen of the, console is erased or as it is overlaid on part of the score display, where the contents of the display are changed sequentially as in FIGS. 31B to 31D so that a "chance" showing that now is a reach state is displayed, and thereafter an explanation of the current reach state is displayed in the screen (a balloon of the astronaut) as shown in FIG. 31E. In the case of, for example, a reach display of "all spares", the display may be "If you spare in the current and next frames, it'll be all spares. Good fight!"

FIG. 32 is a view showing a display example of the aforementioned big hit. If the score state or pin state has actually come to the specific state as a result of the bowl at this time, then the moon landing module takes off with a display of "big hit" presented in the flame as shown in FIGS. 32A to 32D, and thereafter a display that coins and jewels are launched and finally the points to be added is displayed as shown in FIGS. 32E and 32F.

Next, the arrangements of an automatic bowling scoring apparatus, as well as a service information output method for a bowling alley, which are seventh embodiments of the present invention are described with reference to FIGS. 33 to 36.

In the foregoing embodiments, a score sheet or a gift-exchange receipt is printed out as the service medium. In the seventh embodiment, by contrast, models in a number corresponding to the contents of the service are actually discharged.

Figure 33:
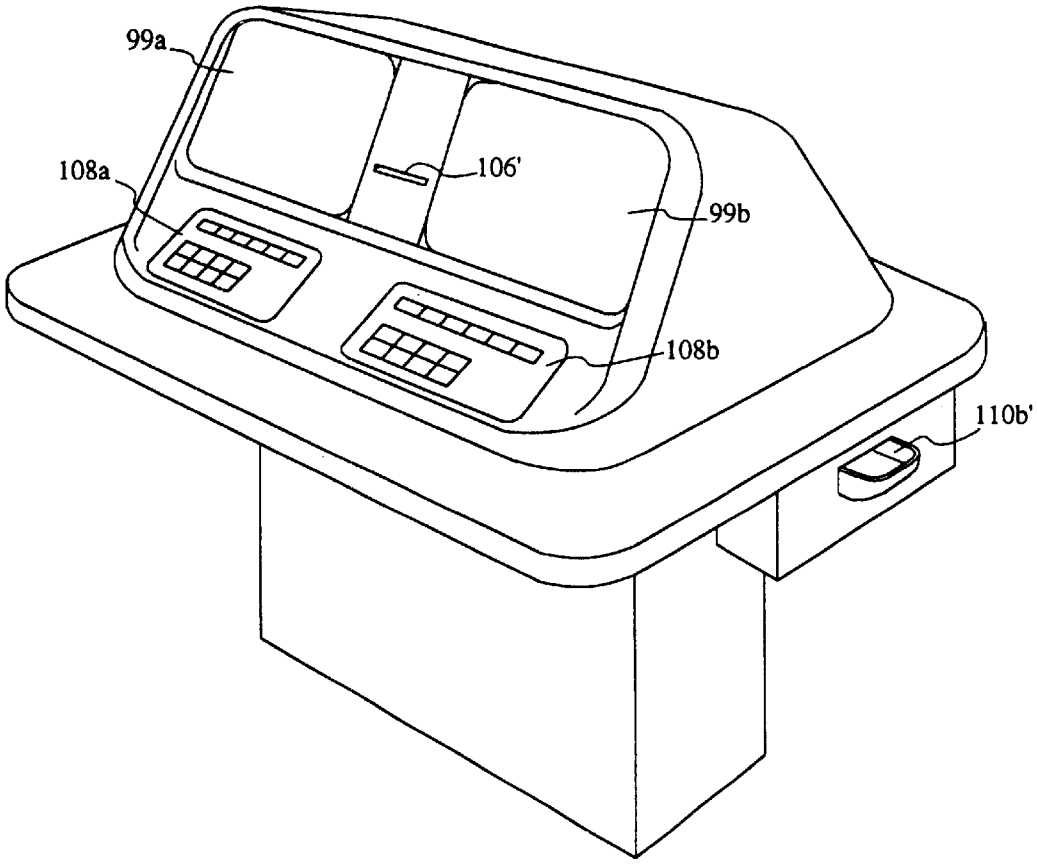
FIG. 33 is a perspective view of the appearance of the console according to the seventh embodiment.

FIG. 33 is an appearance perspective view showing the arrangement of the console. Referring to FIG. 33, numerals 99*a*, 99*b* each denote a CRT for displaying the score as well as points other than the score, and numerals 108*a*, 108*b* each denote a keyboard used for the correction of the names of bowlers, the correction of the score, and the like. Numeral 106' denotes a paper outlet of the printer for outputting score sheets and the like, and numeral 110*b*' denotes a tray for receiving medals from a medal hopper provided inside. This console has the same arrangement as the console shown in the first embodiment except that the medal hopper is provided.

Figure 34:
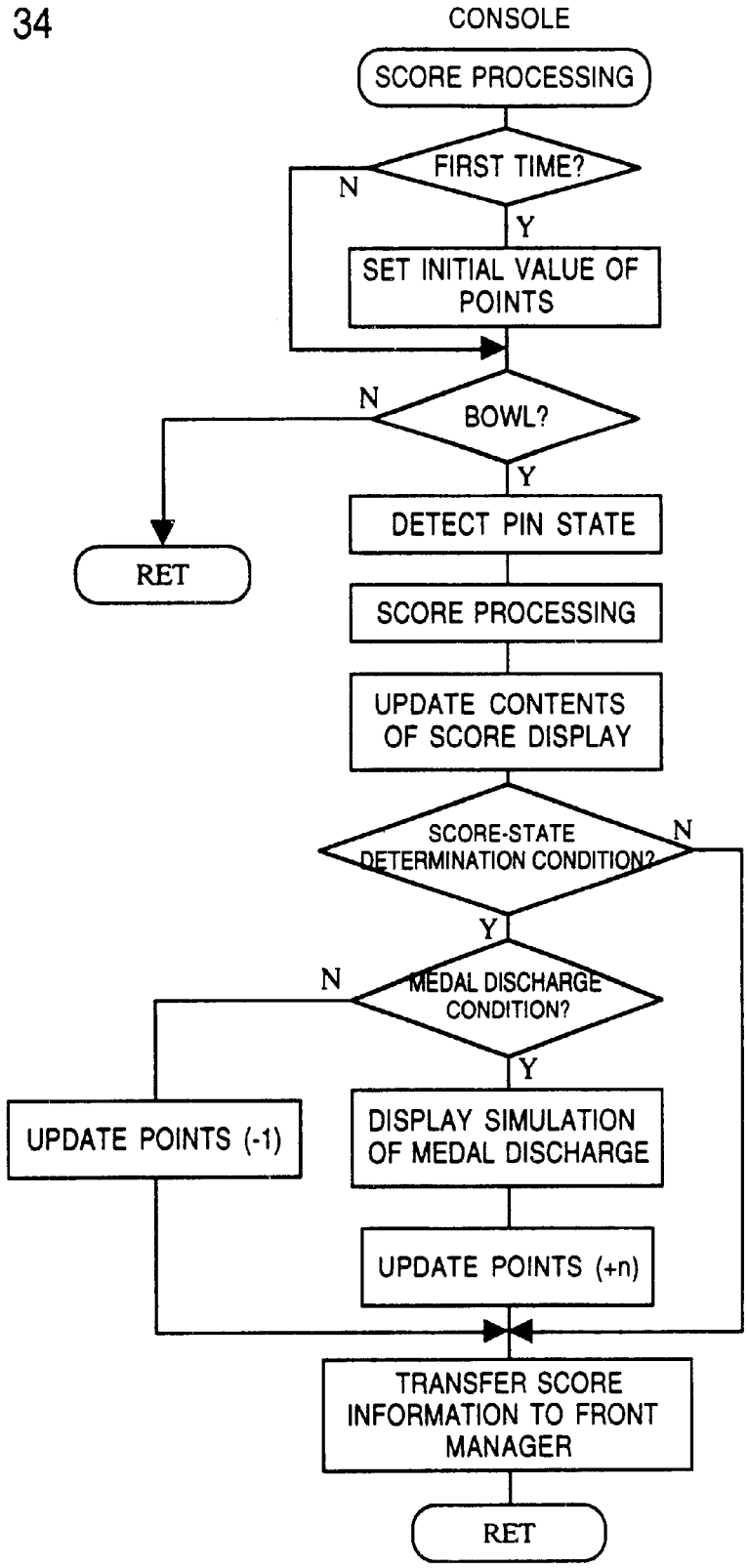
FIG. 34 is a flow chart showing the procedure of score processing by the console according to the seventh embodiment.

FIG. 34 is a flow chart showing the contents of score processing by the console. In the console, first, 10 points as an example are set as the initial points for each bowler. Upon a bowl, the resulting pin state is detected, and the scoring process is executed based on this detection result. Subsequently, the contents of the score display are updated responsively, where if the current score state or pin state has come to a predetermined state (e.g., a spare, a strike, or a succession of strikes) under a condition of score state determination (e.g., at an end of one-frame bowls), then a specified point is added to the point of the pertinent bowler, followed by the simulative display of discharging medals in a number corresponding to the added-up point, and by the updating of the point. During this process, a medal-discharge effective sound is produced in accompaniment to the simulative display of medal discharge. If the current score state or pin state has not come to the predetermined state under the condition of score state determination, 1 is subtracted from the point of the pertinent bowler. After that, score information including the point is transferred to the front manager.

Figure 35:
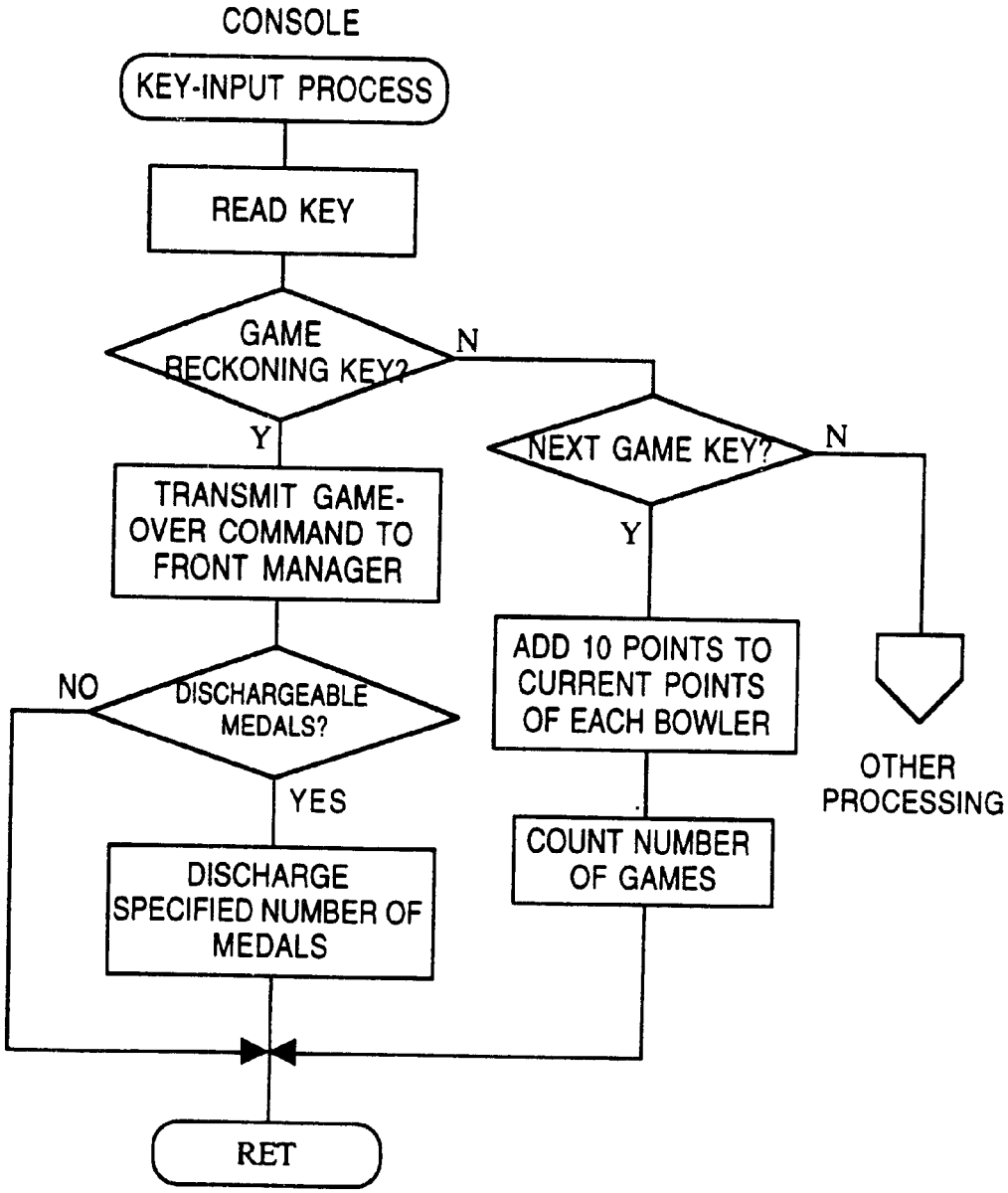
FIG. 35 is a flow chart showing the procedure of key-input process by the console according to the seventh embodiment.

FIG. 35 is a flow chart showing the contents of key-input process executed by the console. Upon some key operation, the console reads it; for example, if the game-account key is operated, the console transmits a game-over command to the front manager and then, with dischargeable medals coming up, counts the number of medals corresponding to the points and besides discharges the medals to the tray. As another example, if a "next game key" is operated, the console adds each 10 points to the points of the respective bowlers and sets them as new points for the next game. In this case, in accompaniment to this key operation, the count value of game number is incremented by +1. Like this, the points are be accumulated on. through the addition of games, which arrangement would increase the cases where the customers continuously play the game with the aim of acquiring additional points.

Figure 36:
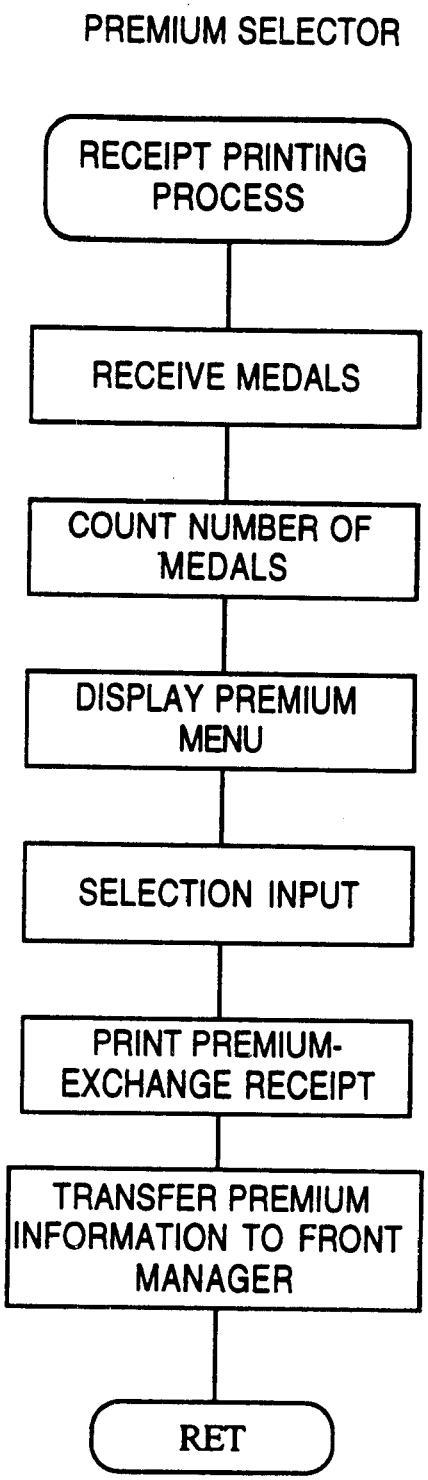
FIG. 36 is a flow chart showing the procedure of processing by the gift selector according to the seventh embodiment.

FIG. 36 is a flow chart showing the procedure of processing by the gift selector. This gift selector, unlike the one shown in FIG. 19, has a medal slot for receiving a medal, and a medal counter for counting medals thrown therethrough. Otherwise, the arrangement is the same as that of the gift selector shown before. The gift selector first receives medals, and counts the number of them. Then, the gift selector displays in a list the designations of exchangeable gifts responsive to the counted number of medals as shown in FIGS. 7A or 8A. However, the display at this time is the same as shown in FIGS. 7A or 8A except that there are no indications of key names of function keys. Then, the gift selector awaits any operation of the touch panel. When any one gift-name field out of the selectable gift designations is touched, the gift selector prints out a gift-exchange use receipt and transfers the information to the front manager.

Next, the arrangements of an automatic bowling scoring apparatus as well as a bowling alley management system and a service information output method for a bowling alley, including the automatic bowling scoring apparatus, which are eighth embodiments of the present invention are described with reference to FIG. 37. In the foregoing embodiments, it has been arranged that, in response to a score counting result or pin-state detection result, service information is determined or points other than the score of the bowling game are increased or decreased or some game other than the bowling game is displayed. In the eighth embodiment, by contrast, points other than the score of the bowling game are increased or decreased at a specified probability, and service is offered to customers in response to the points.

Figure 37:
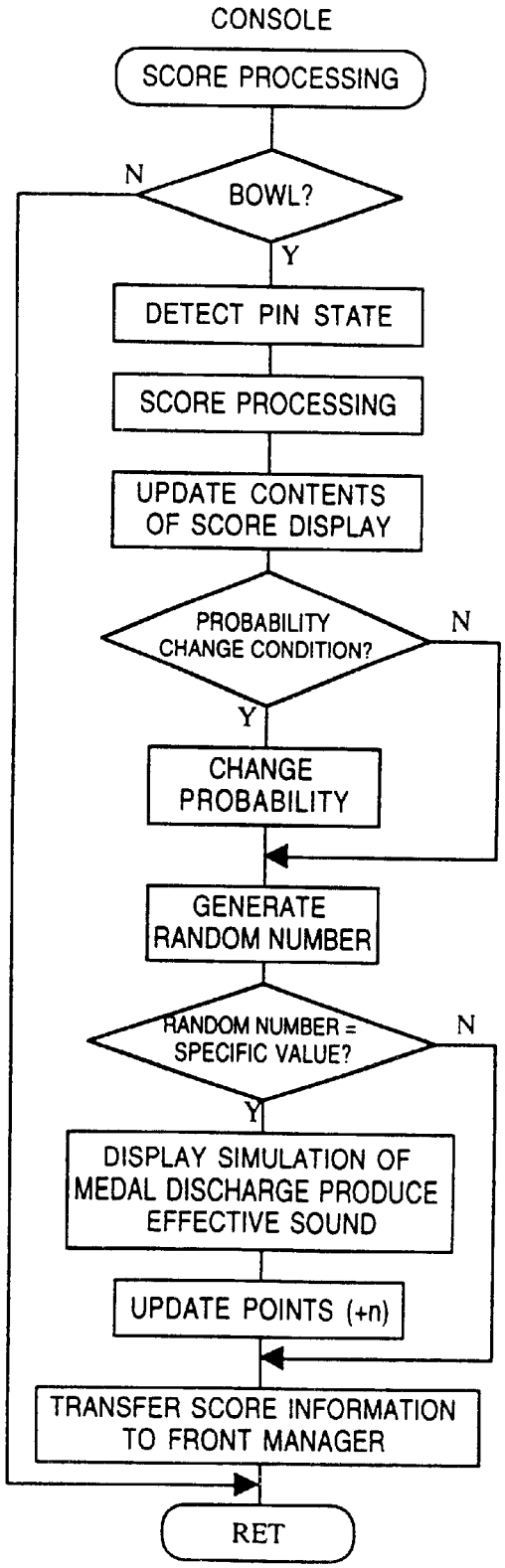
FIG. 37 is a flowchart showing the procedure of score processing by the console according to the eighth embodiment.

FIG. 37 is a flow chart showing the contents of principal processing by the console corresponding to the automatic bowling scoring apparatus and the console. First upon a bowl, the console detects the resulting pin state, and executes the scoring process, the counting of frame number or the counting of game number based on the detection result. Subsequently, the console updates the contents of the score display responsively, where if there has arisen a condition for changing the probability of occurrence of a specific value, the probability is changed as will be described later. Subsequently, the console generates a random number, where if the value of the random number has come to a specific value, the console adds a specified point to the points of the bowler and effects a simulative display of discharging medals in a number corresponding to the added- up points, while it also updates the point display. During this process, the console also generates a medal-discharge effective sound in accompaniment to the simulative display of medal discharge. Thereafter, the console transfers score information including the points to the front manager. The process of determining whether or not "random number=specific value" in FIG. 37 may be, for example, generating a random number in a specified random number, adding a point if the resulting value falls within a specified range of the specific value, and determining the probability of adding the points according to the range of the specific value. For instance, a uniform random number of 0.0 to 1.0 is generated, where if the random number is less than a specified value (a value of probability represented by 0.0 to 1.0), the point may be added.

In addition, whereas a fixed probability may be used as the probability at which the specific value (i.e., a probability at which a random number within the range of the specific value occurs) is generated, the probability is changed according to the skill of bowlers under the following conditions:

F1. Rules for Skilled Bowlers:

(1) The probability of occurrence of the specific value is increased upon occurrence of a strike;

(2) The higher the degree of difficulty of pin arrangement that has been cleared is, the higher the probability of occurrence of the specific value is increased.

F2. Rules for Unskilled Bowlers:

(1) The probability of occurrence of the specific value is increased upon occurrence of a gutter or misbowl;

(2) The lower the degree of difficulty of pin arrangement that has not been cleared is, the higher the probability of occurrence of the specific value is increased.

In the above eighth embodiment, points other than the score of the bowling game are increased or decreased at a specified probability, and service is offered to customers in response to the points. By contrast, when the contents of the service are determined at a specified probability during the bowling game, the contents of the service may be determined in response to the value of the generated random number. A random number in a specified random number string at a specified timing at which, for example, a bowl is effected, where predetermined service may be offered in response to the resulting range into which the random number has fallen. For example, a uniform random number in a range of 0.0 to 1.0 is produced, where if the random number is equal to or more than 0.0 and less than 0.2, then a coupon for lower-level gifts is printed out as the service medium; if the produced random number is equal to or more than 0.2 and less than 0.25, then a coupon for medium-level gifts is printed out; and if the produced random number is equal to or more than 0.25 and less than 0.26, then a coupon for higher-level gifts is printed out. In addition, although the mode in which the contents of service are selected or in which the service medium is printed out has not been shown in the above-described example, the modes that have already been described for the other embodiments may be adopted.

According to the invention as described above, service to be offered to a customer is outputted as, for example, a gift-exchange use receipt, or otherwise medals, beads, or the like in a number corresponding to contents of the service in response to the score counting result or the pin-state detection result, while service to be offered to a customer is outputted as, for example, a gift-exchange use receipt, or otherwise medals, beads, or the like in a number corresponding to contents of the service, the service being determined at a specified probability. According to the invention, for example, upon a strike or a spare or a coincidence of the score pattern with a predetermined pattern, points other than the score of the bowling game are increased or decreased in response to the score counting result or the pin-state detection result. According to the invention, points other than the score of the bowling game are increased or decreased at a specified probability, and information on service to be offered to a customer in response to the points obtained in this way is outputted as, for example, a gift-exchange use receipt, or otherwise medals, beads, or the like in a number corresponding to contents of the service are discharged. According to the invention, another pastime such as slot machine, roulette, and sugoroku is displayed on a display device in response to the score state, the pin state, while it is displayed at a specified probability according to the inventions, where points other than the score of the bowling game are increased or decreased on condition that the contents of this pastime have come to a predetermined state, and then information on the service to be offered to the customer in response to the points obtained in this way is outputted as, for example, a gift-exchange use receipt, or on which medals, beads, or the like in a number corresponding to the contents of the service are discharged. Therefore, the excitement of the bowling game can be enhanced by arousing the customer's passion for gambling with an appeal to actual profits.

According to the invention, a plurality of service contents are displayed in a list in response to the points obtained by the pastime accompanying the bowling game or the like, allowing the customer to make a selective operation, where information on the service selected is outputted as, for example, a gift-exchange use receipt. Therefore, the gifts as an aim add to the pleasure of the bowling game so that customers are attracted, while the procedure of exchanging with gifts is partly automatized so that the working burden on the bowling alley side is reduced.

According to the invention, the contents of service for customers are printed out along with[]the score of the bowling game. Therefore, without outputting any special gift-exchange use receipt or the like, the customers are allowed to receive service such as gift exchange at the time of game account with the score sheet.

According to the invention, a service medium which has recorded thereon information on service to be offered to the customer is outputted from the host unit. Therefore, when the host unit is provided at the front or the like, services such as offering customers gifts-can be carried out in response to the contents or number of the service medium outputted at the front, without providing any printer on the console side, and without providing any medal or bead discharging device on the console side.

According to the invention, a plurality of service contents are displayed in a list in response to the score of the-bowling game or the pin state after a bowl, or in response to the points obtained by another pastime accompanying the bowling game, on the console side, where a selective operation by the customer is read and the information on the selected service is transferred to the host unit. Therefore, the customer is enabled to select from among the service contents, while the content of the selection can be grasped on the host unit side.

According to the invention, a plurality of service contents are displayed in a list by the host unit in response to points or the like transmitted from the console, enabling the operation of selection therefrom to be carried out on the host unit side. Therefore, it becomes possible for the customer or the front clerk to make a selection-of service contents on the front side.

According to the invention, the score of the bowling game is printed on the host unit side, where the contents of the service to be offered to the customer are printed in part of the printout. Therefore, the contents of the service to be offered to the customer can be recorded and confirmed without printing any special sheet.

According to the invention, information on service to be offered to the customer or points themselves are written into a service medium such as a memory card or magnetic card. The information on service or score counting result is read from the service medium by the medium-content output unit, and displayed or printed. Therefore, the medium-content output unit, if provided at the front, makes it possible that the card is received from the customer and read by the medium-content output unit after the end of the bowling game, so that service is offered.

According to the invention, a plurality of service contents are displayed in a list in response to the score counting result, the pin state after a bowl, or points by another pastime, on the console side, and information on service selected by the customer is written into a service medium such as a magnetic card. Therefore, the customer is allowed to receive desired service soon by making the service medium read by the medium-content output unit.

According to the invention, a plurality of service contents are displayed in a list in response to points read from a service medium such as a magnetic card on the medium-content output unit side, and information on service selected is displayed or printed. Therefore, if the medium-content output unit is provided, for example, at the front, the content of the service can be determined through an operation by a front clerk. Also, if the medium-content output unit is provided at a location where the customer can make a selection of service content, then the service content can be selected through an operation of selection by the customer.

According to the invention, a portion of the points corresponding to the service that has been offered to the customer is subtracted from the service medium such as a card. Therefore, it becomes possible to divisionally offer different types of services or the same type of service in several times.

According to the inventions, information on service to be offered to the customer or the like is transferred to the host unit. Then, upon reception by the host unit, the information on service to be offered to the customer is written into a service medium such as a magnetic card, and displayed on the display section or printed by the host unit. Therefore, service for customers is enabled on the basis of the service medium, such as cards, without providing any card reader/writer or the like on the console side.

What is claimed is:

1. A method of outputting a score of a bowling game, comprising:

detecting a pin state after a bowl of a ball in a lane;

determining a game score by summing (a) a bowling score of a bowling game based on the pin state, and (b) a bonus score based on predetermined criteria;

displaying the game score and a non-numeric image representing the game score, wherein the image is determined in response to the game score;

reading an initial service score from a service card via a card reader/writer, wherein the service card includes a magnetic medium;

printing a first output service score on a paper score card via a single printer, wherein the single printer and the card reader/writer are housed within a single bowling console; and writing a second output service score to the service card via the card reader/writer.

2. The method according to claim 1, wherein the single printer is used to print (a) a first service score for a user bowling on a first lane, and (b) a second service second score for a user bowling on a second lane.

3. The method according to claim 1, further including utilizing a gift selector device to allow a user to select a gift based on the second output service score, wherein the gift selector device is separate from the console, and includes a second card reader/writer, a display panel, an a gift printer to print a gift-exchange receipt.

4. The method according to claim 1, wherein the second output service score after a game is utilized as a second initial service score for a subsequent game.

5. The method according to claim 1, wherein the second output service score is determined by subtracting the first output service score from a sum of the game score and the initial service score.

6. A bowling alley management system, comprising:

a pin detector to detect a pin state after a bowl of a ball in a lane;

a score counter to determine a game score by summing (a) a bowling score of a bowling game based on the pin state, and (b) a bonus score based on predetermined criteria;

a console to display the game score and a non-numeric image representing the game score, wherein the image is determined in response to the game score, a card reader/writer to (a) read an initial service score from a service card via a card reader/writer, and (b) write a second output service score to the service card, wherein the service card includes a magnetic medium; and a single printer to print a first output service score on a paper score card, wherein the single printer and the card reader/writer are housed within the console.

7. The system according to claim 6, wherein the single printer is used to print (a) a first service score for a user bowling on a first lane, and (b) a second service score for a user bowling on a second lane.

8. The system according to claim 6, further including a gift selector device to allow a user to select a gift based on the second output service score, wherein the gift selector device is separate from the console, and includes a second card reader/writer, a display panel, and a gift printer to print a gift-exchange receipt.

9. The system according to claim 6, wherein the second output service score after a game is completed is utilized as a second initial service score for a subsequent game.

10. The system according to claim 6, wherein the second output service score is determined by subtracting the first output service score from the sum of the game score and the initial service score.

11. A method of awarding prizes in response to points scored during a bowling game, the method comprising:

detecting a pin state after a bowl of a ball in a lane;

determining a game score by summing (a) a bowling score of a bowling game based on the pin state, and (b) a bonus score based on predetermined criteria;

displaying the game score and a non-numeric image representing the game score, wherein the image is determined in response to the game score;

reading an initial service score from a service card via a card reader/writer, wherein the service card includes a magnetic medium;

printing a first output service score on a paper score card via a single printer, wherein the printer and the card reader/writer are housed within a single bowling console;

transferring a second output service score of the user from the console to a prize selection unit, wherein the prize selection unit includes a prize-card reading/writing device to write to the service card the second output service score, wherein the prize selection unit displays in a list a plurality of service contents responsive to the second output service score; and displaying service to the user only at the prize selection unit.

12. The method according to claim 11, wherein the single printer is used to print (a) a first service score for a user bowling on a first lane, and (b) a second service second score for a user bowling on a second lane.

13. The method according to claim 11, wherein the second output service score after a game is utilized as a second initial service score for a subsequent game.

14. The method according to claim 11, wherein the second output service score is determined by subtracting the first output service score from the sum of the game score and the initial service score.

* * * * *